US008585554B2

(12) United States Patent
Shavit et al.

(10) Patent No.: US 8,585,554 B2
(45) Date of Patent: Nov. 19, 2013

(54) METHOD AND APPARATUS FOR ELECTRONICALLY CONTROLLED RESISTANCE IN EXERCISE EQUIPMENT

(75) Inventors: Arie Shavit, Herzeliya (IL); Zvi Shavit, Rishon-Le-Zion (IL); Efraim Avraham, Kfar-Saba (IL); Alon Shavit, Rishon-Le-Zion (IL); Michael Ganor, Even-Yehuda (IL); Idit Perl Shavit, Herzeliya (IL)

(73) Assignee: Flow-Motion Research and Development, Herzeliya (IL)

( * ) Notice: Subject to any disclaimer, the term of this patent is extended or adjusted under 35 U.S.C. 154(b) by 0 days.

(21) Appl. No.: 13/359,216

(22) Filed: Jan. 26, 2012

(65) Prior Publication Data

US 2012/0190503 A1 Jul. 26, 2012

Related U.S. Application Data

(60) Provisional application No. 61/436,426, filed on Jan. 26, 2011.

(51) Int. Cl.
*A63B 21/005* (2006.01)
*A63B 21/02* (2006.01)
*A63B 21/04* (2006.01)

(52) U.S. Cl.
USPC ..... 482/5; 482/121; 482/129

(58) Field of Classification Search
USPC ..... 482/44, 45, 123, 130, 121, 129
See application file for complete search history.

(56) References Cited

U.S. PATENT DOCUMENTS

| | | | | | |
|---|---|---|---|---|---|
| 3,770,267 | A | * | 11/1973 | McCarthy | 482/130 |
| 3,815,904 | A | | 6/1974 | Weiss et al. | |
| 3,871,646 | A | * | 3/1975 | Slack | 482/48 |
| 4,564,191 | A | * | 1/1986 | Atkin | 482/130 |
| 4,600,196 | A | | 7/1986 | Jones | |
| 4,666,149 | A | * | 5/1987 | Olschansky et al. | 482/130 |
| 4,706,953 | A | * | 11/1987 | Graham | 482/96 |
| 4,725,057 | A | | 2/1988 | Shifferaw | |
| 4,811,946 | A | * | 3/1989 | Pelczar | 482/5 |
| 5,066,005 | A | * | 11/1991 | Luecke | 482/96 |
| 5,074,551 | A | * | 12/1991 | Olschansky et al. | 482/137 |
| 5,451,191 | A | * | 9/1995 | Beenken | 482/47 |
| 5,522,784 | A | * | 6/1996 | Grant | 482/130 |
| 5,586,962 | A | | 12/1996 | Hallmark | |
| 6,042,523 | A | * | 3/2000 | Graham | 482/121 |
| 6,045,491 | A | * | 4/2000 | McNergney et al. | 482/121 |
| 7,125,368 | B2 | * | 10/2006 | Endelman | 482/142 |
| 7,192,391 | B2 | | 3/2007 | Kim | |
| 7,288,053 | B2 | * | 10/2007 | Endelman et al. | 482/142 |
| 7,597,653 | B1 | * | 10/2009 | Lindemeier | 482/129 |

(Continued)

FOREIGN PATENT DOCUMENTS

DE 3717789 12/1988

*Primary Examiner* — LoAn H. Thanh
*Assistant Examiner* — Shila Jalalzadeh Abyane
(74) *Attorney, Agent, or Firm* — Myers Wolin, LLC

(57) ABSTRACT

A system for controlling the tension in an exercise apparatus includes a plurality of connectors that are collectively attached to a holder, the holder being movable relative to a fixed support, each connector further comprising a catch for independent attachment to a tension member from an exercise apparatus. Different combinations of tension members can be attached to the connectors with an electronic control system to create a desired tension arrangement, while the holder including all of the connectors can be moved to further fine tune the tension arrangement of the tension members.

15 Claims, 23 Drawing Sheets

(56) References Cited

U.S. PATENT DOCUMENTS

| | | | | |
|---|---|---|---|---|
| 7,608,025 | B1 | 10/2009 | Best | |
| 7,815,552 | B2 | 10/2010 | Dibble et al. | |
| 7,931,570 | B2 * | 4/2011 | Hoffman | 482/123 |
| 7,955,229 | B2 * | 6/2011 | Graham | 482/70 |
| 8,052,585 | B2 * | 11/2011 | Donaldson | 482/130 |
| 8,137,247 | B2 * | 3/2012 | Gerschefske et al. | 482/96 |
| 8,192,338 | B2 * | 6/2012 | Solow et al. | 482/142 |
| 2007/0270293 | A1 * | 11/2007 | Zhuang | 482/123 |
| 2009/0023561 | A1 * | 1/2009 | Ross et al. | 482/92 |

* cited by examiner

METHOD AND APPARATUS FOR ELECTRONICALLY CONTROLLED RESISTANCE IN EXERCISE EQUIPMENT

CROSS-REFERENCE TO RELATED APPLICATIONS

This application claims the benefit of U.S. Provisional Patent Application 61/436,426, filed Jan. 26, 2011, the contents of which are incorporated herein by reference.

FIELD OF THE INVENTION

The present invention relates to exercise equipment generally, and more specifically, to a method and apparatus for electronically controlling resistance in exercise equipment.

BACKGROUND

FIG. 1 illustrates a conventional Pilates reformer 100 having a carriage 110 for accommodating a user's body that rides on rails 120. The movement of the carriage 110 is tensioned through a series of springs 130 that are variably attached to a spring support bar 140 that is fixed in position relative to the rails 120. If no springs 130 are attached to the support bar 140, then the carriage 110 will ride freely on the rails 120 in response to a force applied by a user, such as by a user pulling on hand grips 150 that are attached to the carriage 110 by cords 160 or the like. To increase the resistance to movement of the carriage relative to the rails 120, to thereby make it more challenging for a user to move the carriage 110, additional springs 130 are successively attached to the spring support bar 140 until the desired spring tension is achieved.

In this example, the amount of spring tension experienced by the carriage 110 is a function of the inherent spring characteristics (i.e. material, length, diameter, pitch, number of winds, frequency of compression), the length of an attached spring 130 as defined between the carriage 110 and the support bar 140, the motion of the spring 130 relative to the support bar 140, and the number of springs 130 attached to the support bar 140 at a particular time. If all springs 130 have the same inherent characteristics, then the attachment of five springs 130 to the support bar 140 will generate five times the amount of tension as if only one spring 130 was attached. If each of the springs 130 has a different identifiable inherent characteristic, then the tension can be adjusted by attaching different combinations of springs 130 to the support bar 140, where there are thirty-two possible tension combinations with five springs 130, sixty-four possible tension combinations with six springs, and so on. In addition to the tension characteristics of each spring 130, the support bar 140 position can be adjusted to modify the length of travel of the carriage 110 on the rails 120. Thus, there are large variations in tension that can be achieved by modifying a variety of variables including the position of the support bar 140 and the number of springs 130 attached between the carriage 110 and the support bar 140.

In the above example, the ability to fine tune the tension is limited and can be somewhat challenging, especially if multiple adjustments are necessary in an exercise session. In the case of Pilates spring loaded machines in particular, the sequence of selecting the required resistance is typically not intuitive and not user friendly, and in many occasions the user is required to remember a certain spring combination, or to do a calculation on the spot. Therefore the user may possibly connect the springs incorrectly to achieve a total final resistance which is not what is desired. This may also be true for other types of exercise machines as well.

In addition, adjusting the required resistance in conventional exercise machines is generally inconvenient, requiring that the user stop and change position. Another source of inconveniency is particularly apparent when a machine is being used in a demonstration to several student users, for example. This situation is very common in Pilates classes, where depending on the numbers of students and the class room space, the students frequently cannot witness what adjustments are made as the springs and the adjustment thereof are typically obscured by the frame of the machine.

In addition, manually adjusting the tension can be disruptive and is subject to user error. There is a need, therefore, for a way to more accurately define and control the tension characteristics in an exercise device like the reformer 100 described above.

SUMMARY

A system for controlling the tension in an exercise apparatus includes a plurality of connectors that are collectively attached to a holder, the holder being movable relative to a fixed support, each connector further comprising a catch for independent attachment to a tension member from an exercise apparatus. Different combinations of tension members can be attached to the connectors using an electronic control system to create a desired tension arrangement, while the holder including all of the connectors can be moved to further fine tune the tension arrangement of the tension members. The control system allows a user to accurately modify the tension arrangement without manually manipulating the tension elements, and provides additional input and output functionality that enables a user to engage the exercise apparatus and extract meaningful data that is representative of the user's exercise regimen.

DETAILED DESCRIPTION OF THE PREFERRED EMBODIMENTS

Figure 1:
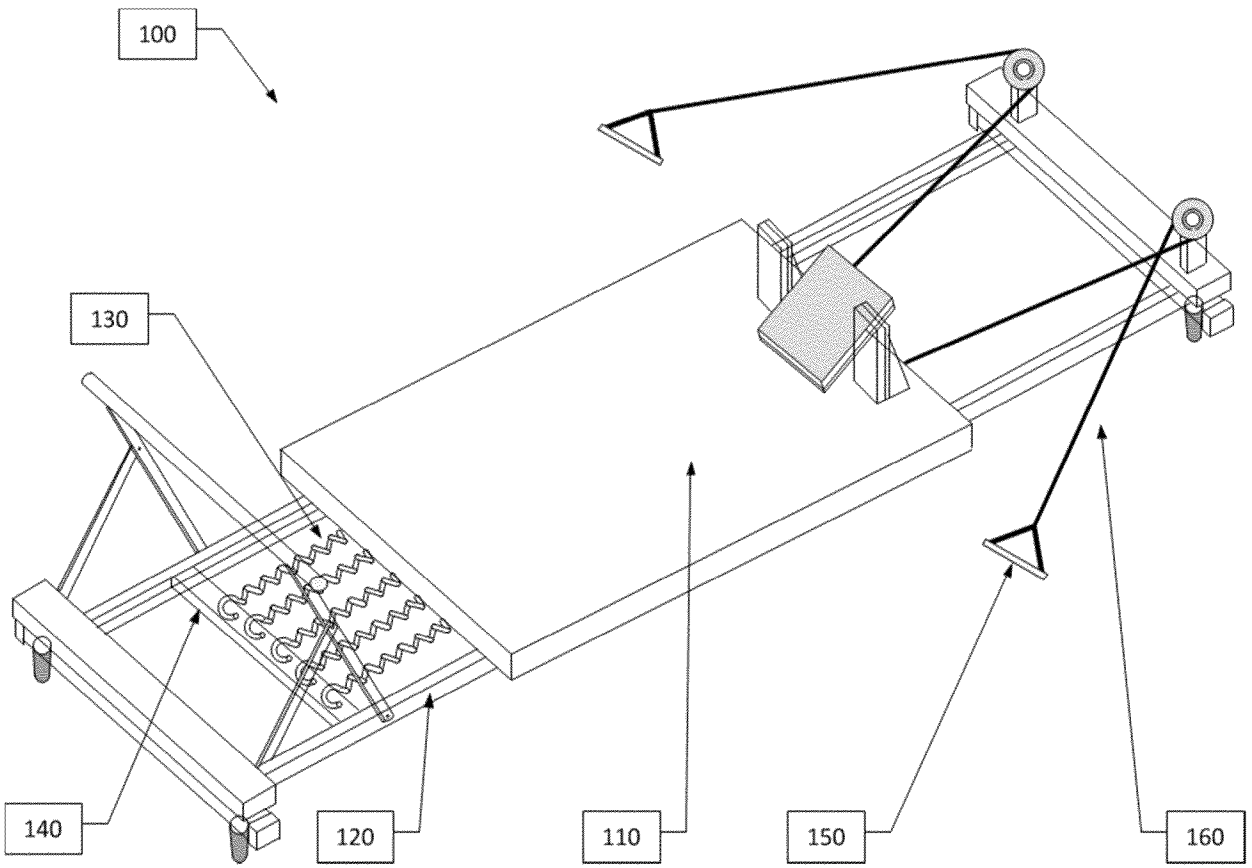
FIG. 1 illustrates a convention Pilates reformer.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2A:
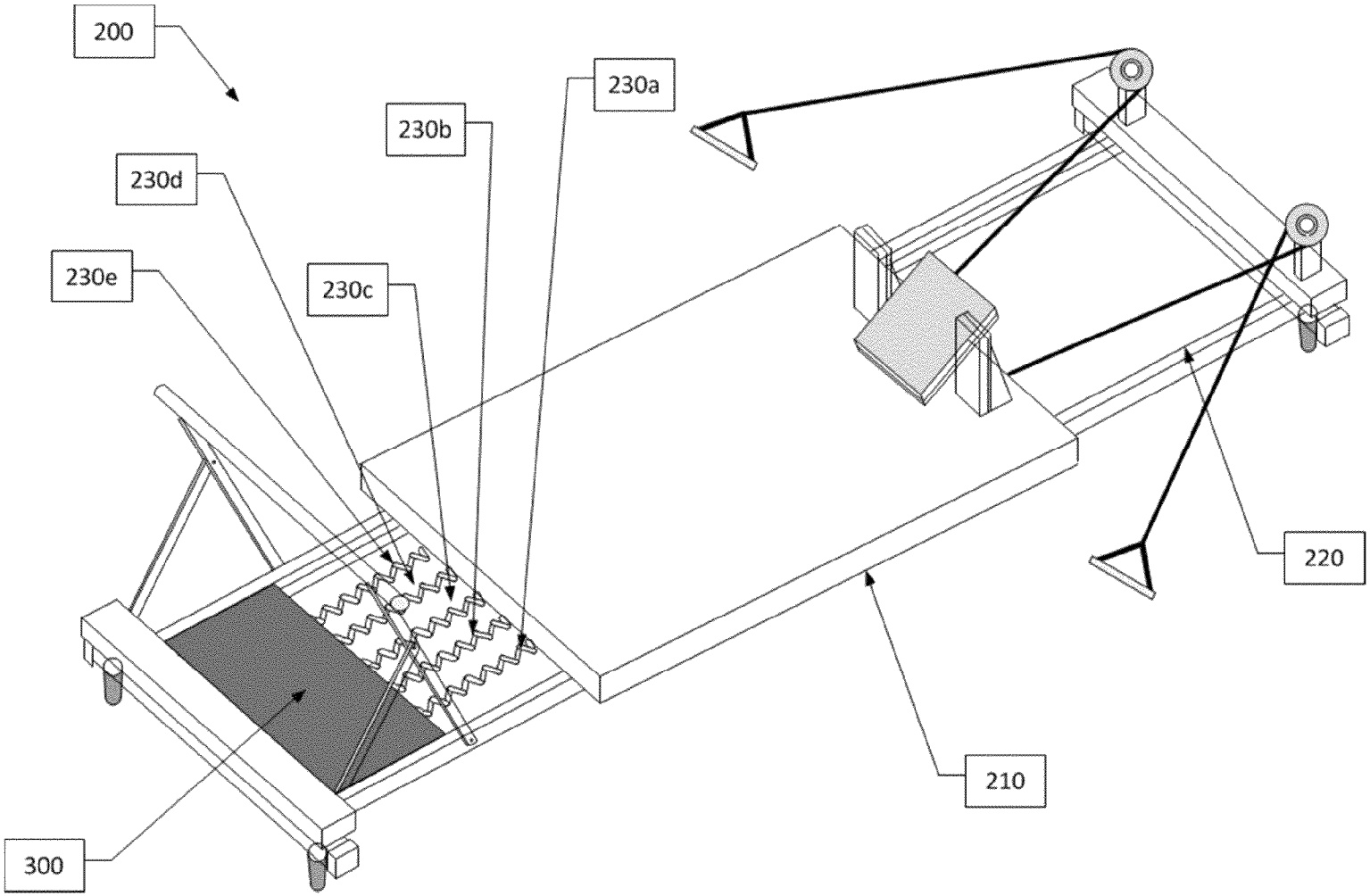
FIG. 2A illustrates one embodiment of an exercise device of the invention.
Figure 2B:
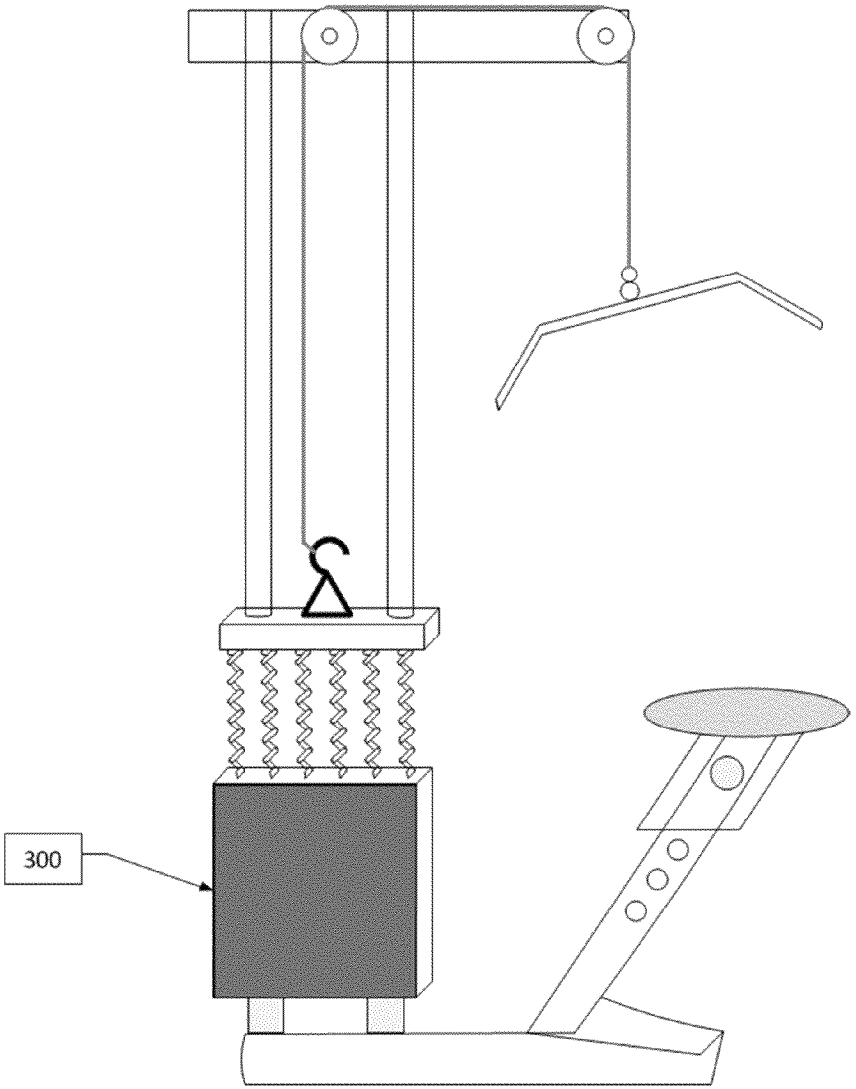
FIG. 2B illustrates an alternate embodiment of an exercise device of the invention.

FIG. 2A illustrates one embodiment of an exercise device 200 of the present invention in the nature of a Pilates reformer 200 having a carriage 210 for accommodating a user's body that rides on rails 220. The movement of the carriage 210 is tensioned through a series of resilient, elastic elements such as springs 230*a* through 230*e* (collectively springs 230) having ring-shaped ends 232*a* through 232*e* (see FIG. 5; collectively ends 232) that are variably attached to a control system 300 for controlling the tension provided by the springs 230 as will be described below. While a Pilates reformer is shown and described, it will be appreciated that the control system 300 may be used with other types of exercise devices now known or hereinafter developed, including, but not limited to a traditional plate loaded weight machine arrangement (FIG. 2B), and other machines including pulley machines, smith machines, leg press machines, arm press machines, pull-over machines, rowing, butterfly machines, etc., where the traditional weight stack (not shown) is replaced with a control system 300 of the present disclosure. Thus, the control system may be portable and transportable and other systems and machines are possible. In addition, while the elastic elements are described as coil springs 230 having ring-shaped ends 232, it will be appreciated that other types of elastic elements or non-elastic elements may be used, including, but not limited to, linear or non-linear springs, without departing from the scope of the present invention.

The control system 300 is generally illustrated in FIG. 3 through FIG. 12 and includes a cover 310 having a control panel 312 and a display 314 with a keypad 316 for communications with a user as will be described below. An additional control panel 322 having a display 324 may be attached to the exercise device 200 by way of a support 326 that is either freestanding or attached directly to the exercise device 200 and preferably associated with the control system 300 for communications with a user as will also be described below. The control panel 322 may also include a keypad (not shown) and speaker 328 and/or other input and output elements (not shown) for communications with a user. The cover 310 is removably positioned over the mechanical and electrical components of the control system 300 and is typically not removed unless it is desired to access the mechanical and electrical components during operation or servicing of the control system 300. Otherwise, the cover 310 primarily serves a protective and an aesthetic function and also prevents a user from inadvertently impacting the components during exercising, transport or the like. The control system 300 operates through a processor 305 that controls and manages the functionality of the control system 300 as will be described in more detail below.

As will be described in more detail below, the control panels 312 and 322 provide a user with various types of information and feedback relating to use of the device 200. The control system 300 preferably includes a data holding system 410 (see the discussion in connection with FIG. 13 below) that includes volatile memory 412 and non-volatile memory 414 (FIG. 13) for storing information relating to the past and present operation of the device by one or more users. For example, information about past exercise workouts may be stored for immediate access and review, analysis and improvement tracking through the control panels, while information about an active workout may be similarly displayed in real time during a present workout. This information might include, for example, the arrangement of the attached springs 230 and the amount of resistance imparted to the carriage 210, the travel length of the carriage 210, the speed and movement of the carriage 210, time elapsed, distance traveled, as well as personal information about the user relating to calories burned, muscle strain, flexibility, heart rate if equipped with a sensor that is able to communicate with a user's heart rate monitor, and so on. The speaker 328 may also be used to play music stored in memory in the control panel or wirelessly transmitted from a user's mobile device, or it may announce statistics relating to the user's workout, or it may be used to provide prerecorded motivational messages and the like. Various sensors may be incorporated into the device to provide real-time feedback and data relating to use of the device, which is then processed and reported to the user through the control panels, for example, and/or to a user's mobile device if equipped with and capable of establishing a wireless connection 462 (FIG. 13) with the exercise device. The system also gives the ability to interface the basic mechanical exercise machine to software running on a computer system. This enables many powerful improvements such as: the possibility to plan ahead the training or training sessions, selecting or creating pre-defined programs aimed at achieving certain goals, and so on.

In one non-limiting example of a resistance calculation, a user may input into a control panel the resistance required or desired in different units such as pounds, for example, and can refer to as a non limiting example the resistance experienced by a user when the carriage is at an arbitrary distance from starting position. This arbitrary distance can be set to enable scaling of the resistance. As an example, one foot away from the carriage starting position.

A spring resistance force is generally given by the following formula:

$$F=KX$$

where F is the spring resistance force, K is the spring constant, and X the elongation of the spring. In this example, the equation can be written:

$$F=K(X_{pre}+X_{cur})$$

Where $X_{pre}$ is the starting bias given by setting the location of the holder 350 after connecting the combination of springs. $X_{cur}$ is the current position of the spring. For a combination of N springs connected to the holder with generally different K values:

$$F_{dis}=\Sigma_{i=0}^{N} w_i K_i (X_{pre}+X_{dis})$$

Where $$w_i = \begin{cases} 1 - \text{if spring is connected} \\ 0 - \text{if spring is not connected} \end{cases}$$

$F_{dis}$ is the resistance chosen by the user at the set distance. $X_{dis}$ is this known distance. and $K_i$ is the spring constant for each elastic element.

The logic unit solves this series of linear equations using methods known to those skilled in the art and finds $w_i$ and $X_{pre}$.

In one non-limiting example of a calculation for calories burned, the energy exerted on an elastic element is given by:

$$E=K\int x dx$$

where x the elongation of the spring. and K is the spring constant. X is integrated over the linear path taken by the spring. The total energy exerted on the spring combination is given by:

$$E=\Sigma_{i=0}^{N} w_i K_i \int (X_{pre}+x) dx$$

Where $$w_i = \begin{cases} 1 - \text{if spring is connected} \\ 0 - \text{if spring is not connected} \end{cases}$$

Using this type of equation and methods known to the skilled in the art, the energy exerted by a user on the spring at any given moment can be calculated. The energy can be presented to the user in the form of calories. Conversion from different set of Energy units may be required.

Figure 4:
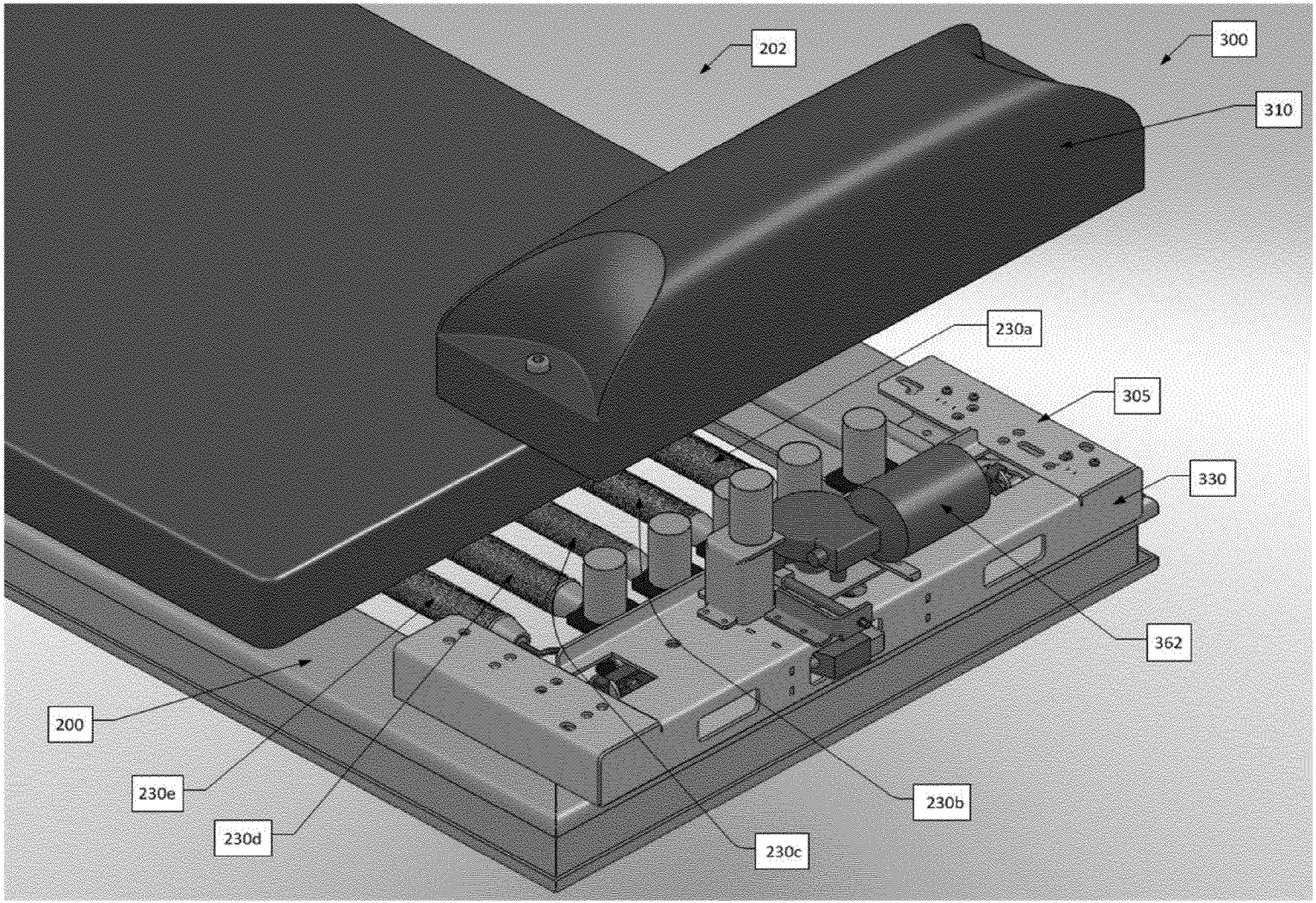
FIG. 4 illustrates one embodiment of a partially exploded rear perspective view of an exercise device of the invention.
Figure 5:
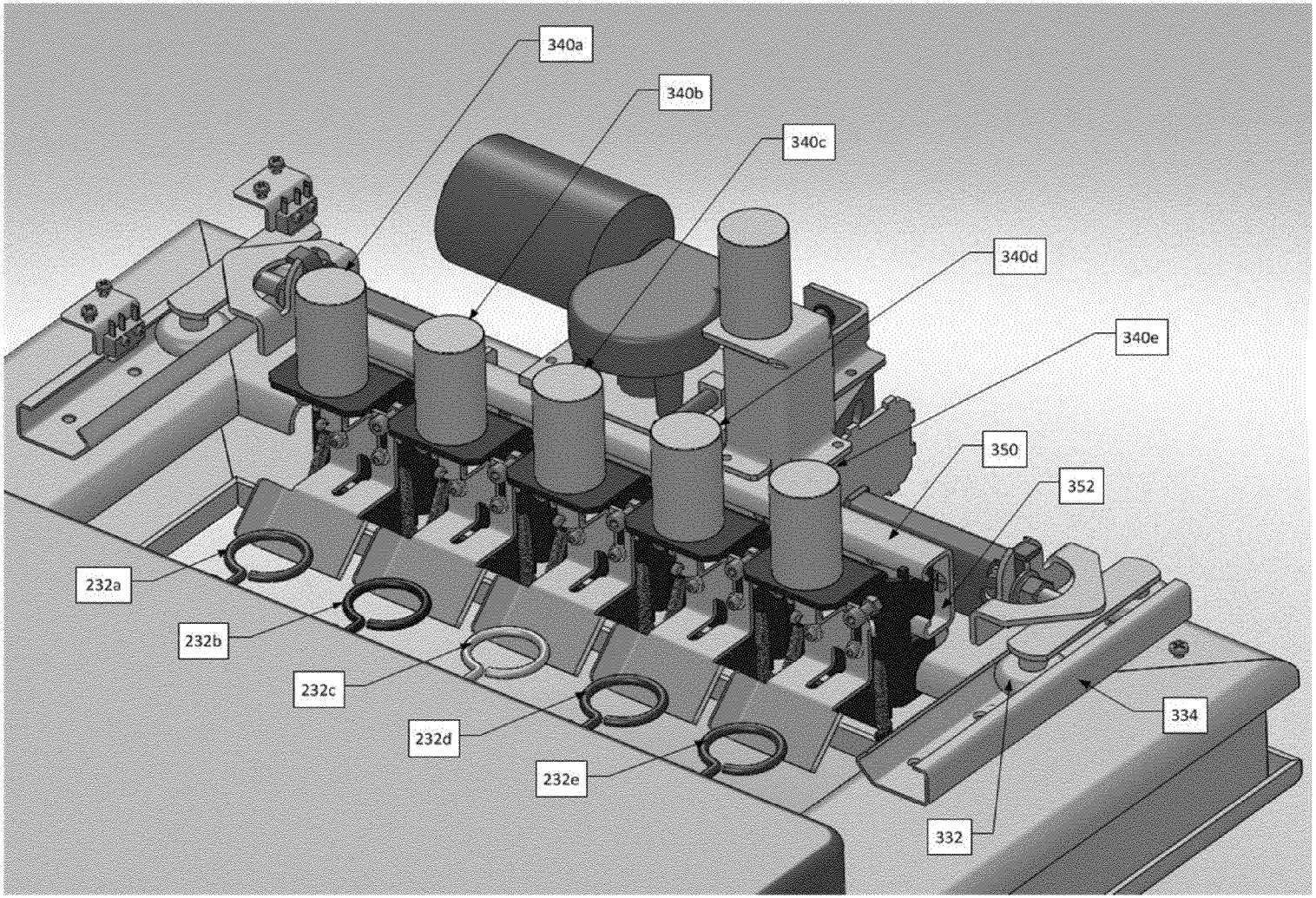
FIG. 5 illustrates one embodiment of a control system used with an exercise device of the invention.

FIG. 4 is a rear view and FIG. 5 is a front view of some of the mechanical and electrical components of the control system 300 including a fixed support 330 in the form of a chassis or housing that attaches the control system 300 to the device 200 and that provides a fixed reference point for connection to the springs 230. A plurality of connectors 340*a* through 340*e* (collectively connectors 340) for attachment to the springs 230 are arranged in series and are collectively attached to a holder 350, the holder 350 being movably attached to the fixed support 330 so that the springs 230, when attached to the connectors 340, can be collectively tensioned or pre-tensioned prior to use as will be described below. The holder 350 is movable via wheels 332 within a track 334 and is connected to a drive system 360 defined by a motor 362 that is coupled to a gear array 364 that translates the rotary motion of the motor 362 into a linear motion of the holder 350 for moving the holder 350 toward and away from the springs 230. While wheels 332 and a track 334 are disclosed, it will be appreciated that other methods of movement are possible. The motor 362 and system overall may be powered through conventional means, such as by a power cord attached to a wall outlet. Other conventional means of powering the device, such as by battery, solar, etc., are possible. Alternatively, a generator and a battery (not shown) may be attached to the carriage 210 so that the movement of the carriage 210 relative to the rails creates enough electricity to power the control system 300 for a standard exercise cycle.

Figure 8A:
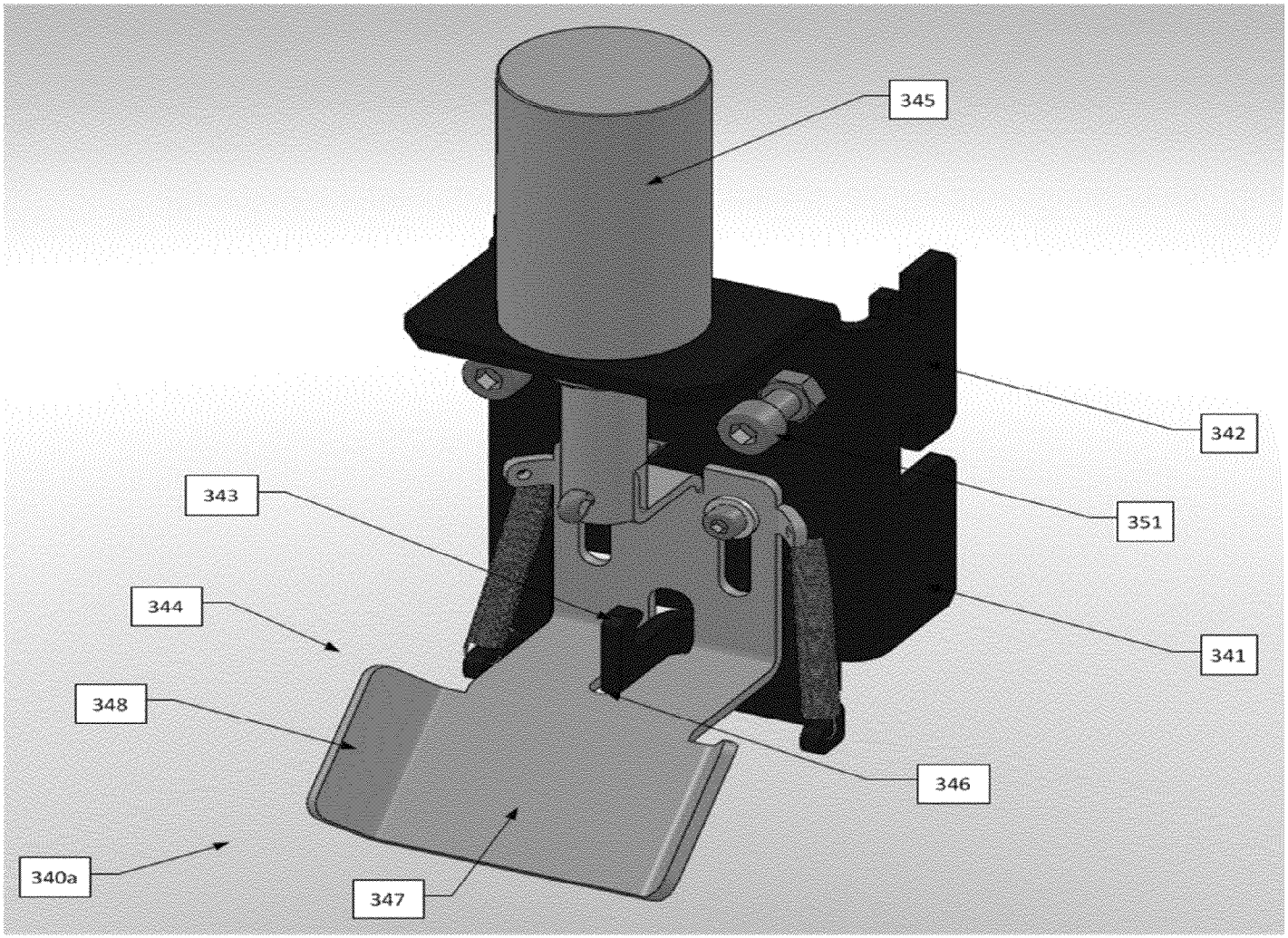
FIG. 8A illustrates one embodiment of a spring connector in a first position and FIG. 8B illustrates one embodiment of a spring connector in a second position.
Figure 8B:
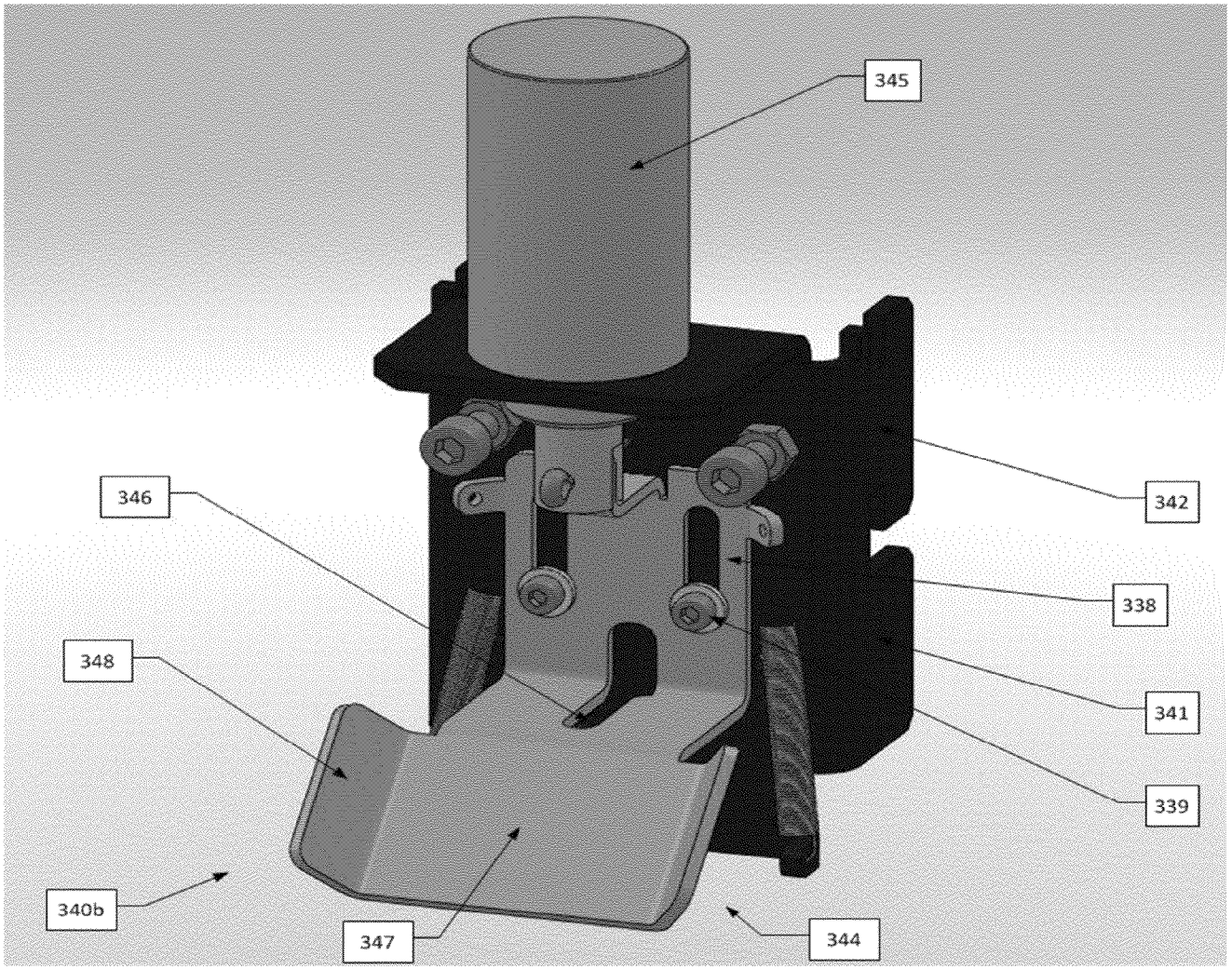

Each connector 340 further comprises a bracket 341 having a rear arm 342 that slides within a channel 352 in the holder 350 and is securable to the channel by a bracket fastener 351, a catch 343 for engagement with a spring 230 as will be described, and a guide plate 344 that is movably actuated relative to the bracket 341 by a solenoid actuator 345 between a first position 340*a* (FIG. 8A) and a second position 340*b* (FIG. 8B). The actuator 345 may operate and may be driven by a variety of components including, but not limited to, servo-motors, piezoelectric crystals, electrically controlled hydraulic pumps controlling a fluid moving a piston, and so on. Any number of connectors 340 may be attached to and positioned within the channel 352 of the holder 350 depending on the number and configuration of the springs 230 present in the exercise device 200. In the embodiment illustrated herein, there are five connectors 340*a* through 340*e* (FIG. 5) to match the five springs 230*a* through 230*e* (FIG. 4) associated with the exercise machine 200. Other numbers and configurations are possible. Each guide plate 344 further comprises an opening 346 for passage of the catch 343 and a ramp 347 with angled sides 348 for directing the spring end 232 into position relative to the opening 346 and the catch 343. The guide plate 344 includes slots 338 that slideably engage with pins 339 on the bracket 341 such that the guide plate 344 is movable by the actuator 345 between a first, lowermost position 340*a* (FIG. 8A; pins 339 at the uppermost end of the slot 338) at rest, where the actuator 345 is not energized and the catch 343 extends through the opening 346 for engagement with the spring end 232, and a second position 340*b* (FIG. 8B; pins 339 at the lowermost end of the slots 338) due to the energizing of the actuator 345, which elevates the guide plate 344 relative to the catch 343 to position the opening 346 above the catch 343 in preparation for receiving the end 232 of the spring 230.

Figure 6:
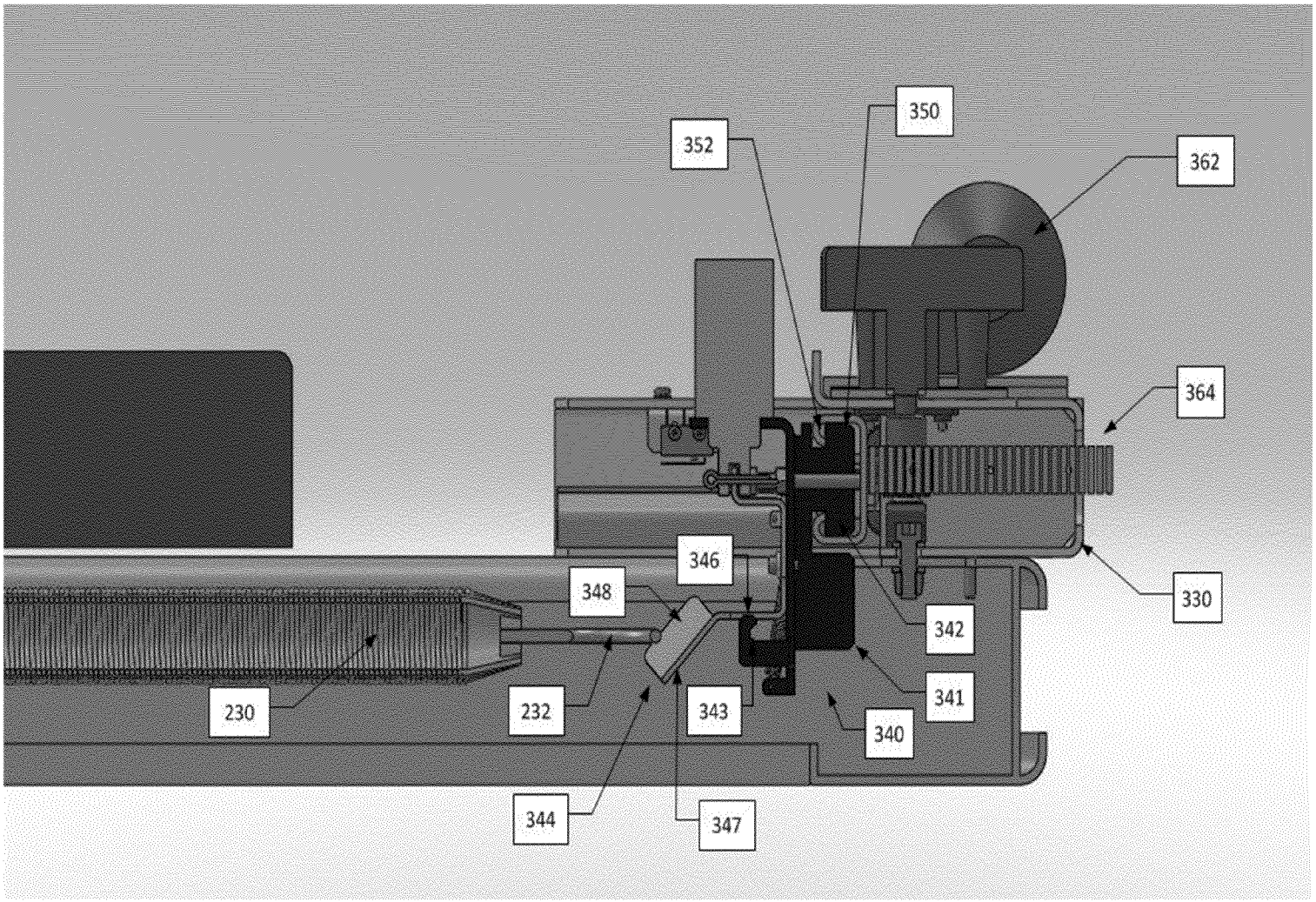
FIG. 6 illustrates one embodiment of a partial cross-section of an exercise device of the invention.
Figure 7:
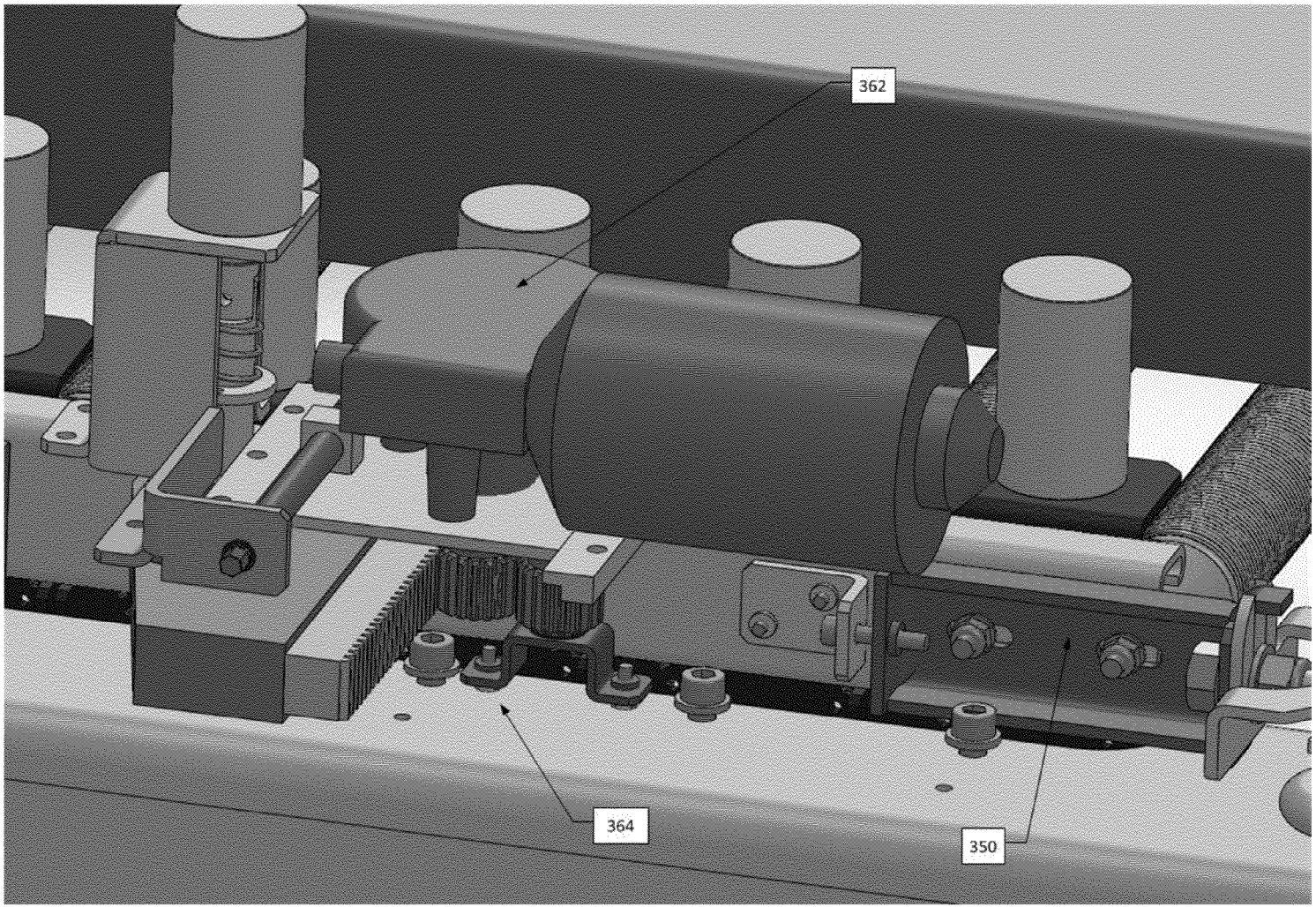
FIG. 7 illustrates one embodiment of a close-up rear view of an exercise device of the invention.
Figure 9:
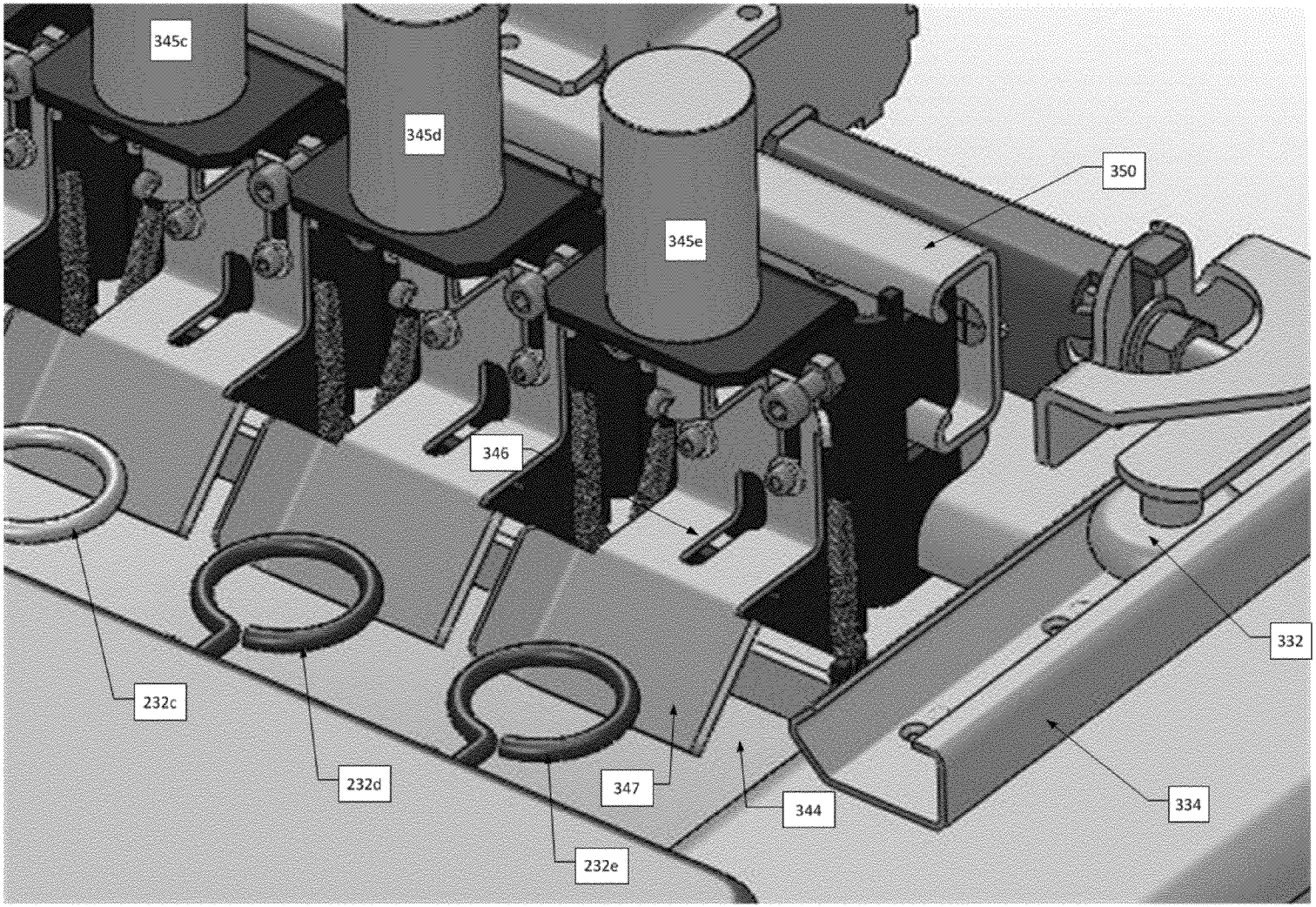
FIG. 9 through FIG. 12 illustrate one embodiment of springs attaching to connectors in a control system of the invention.
Figure 10:
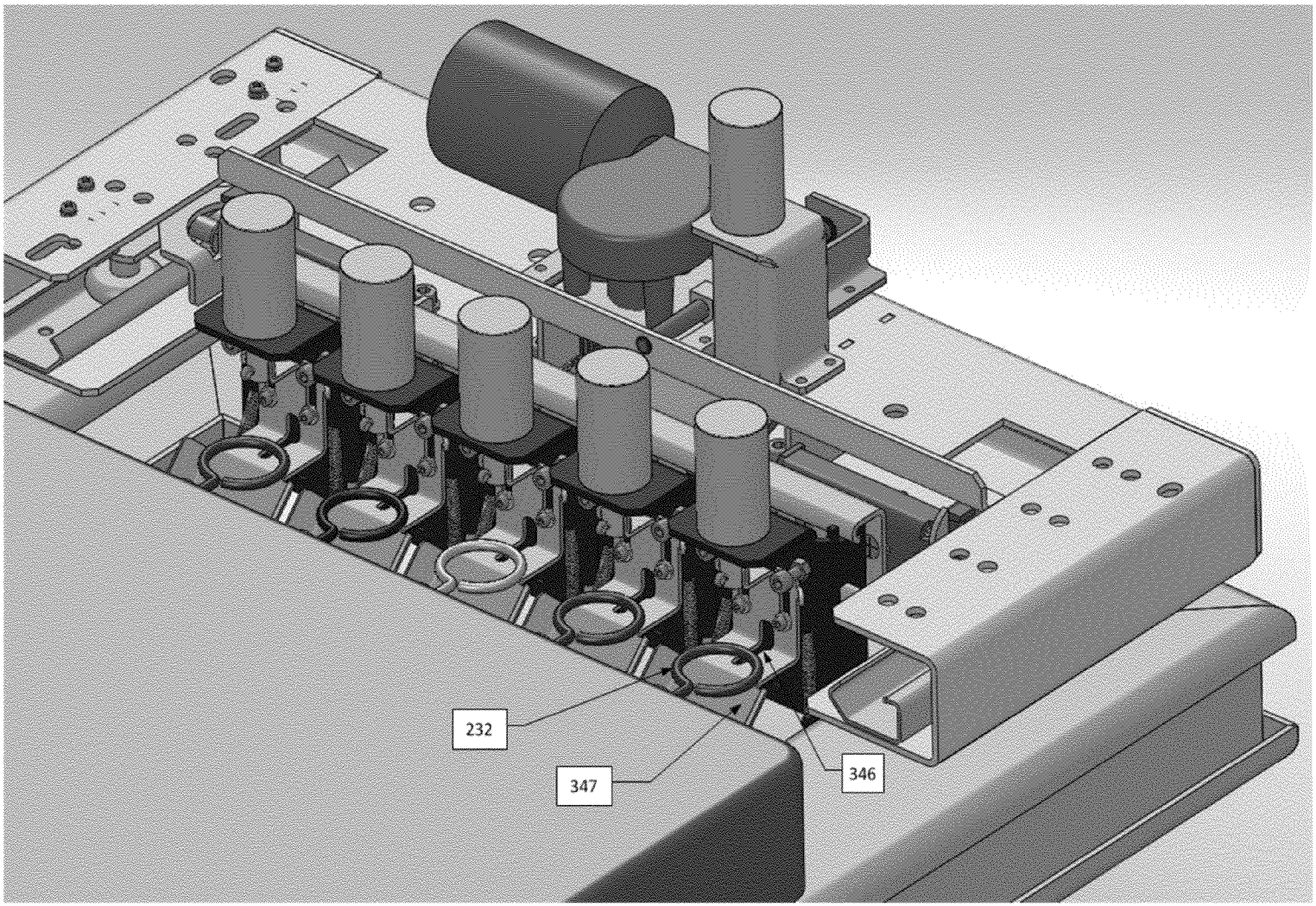
Figure 11:
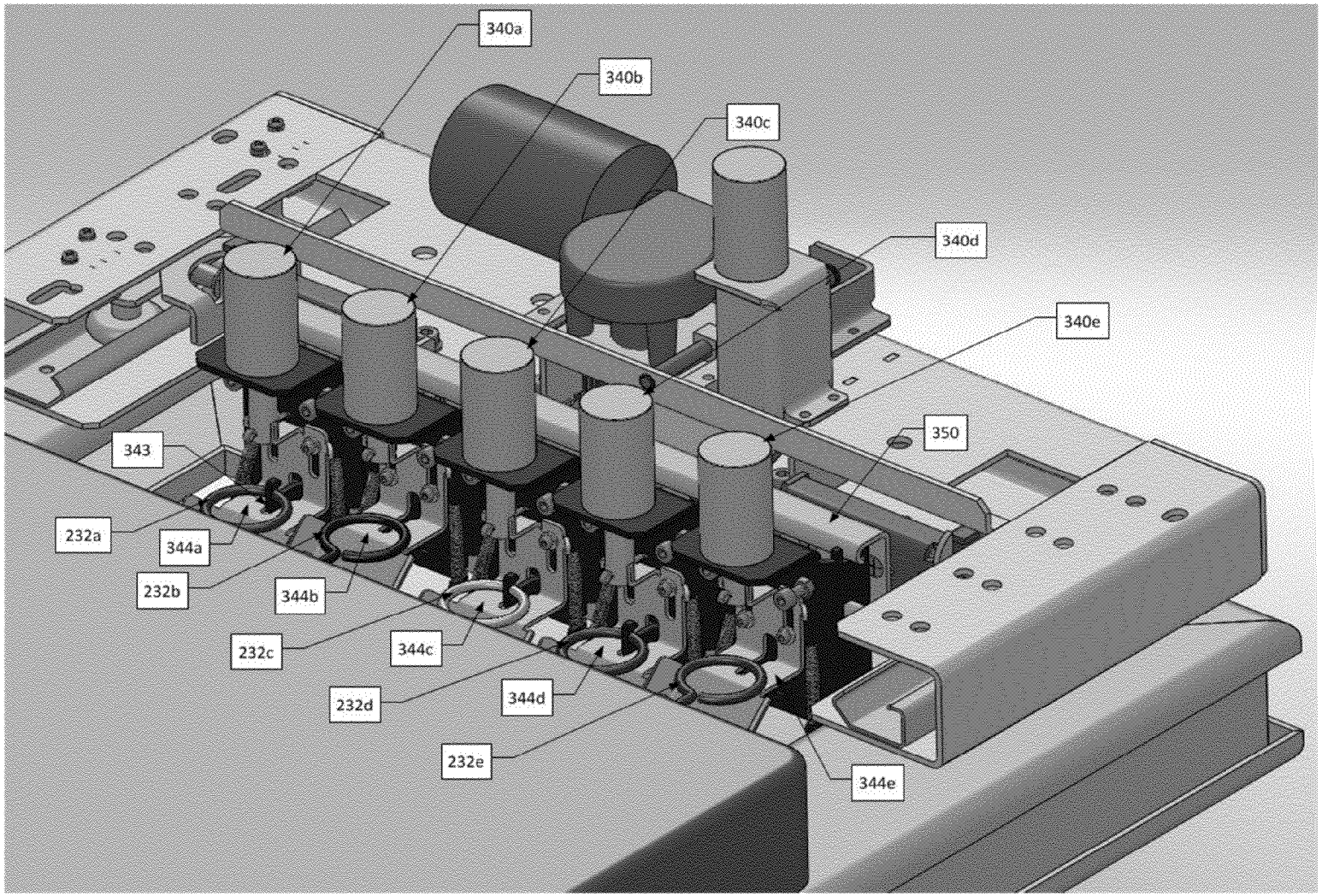
Figure 12:
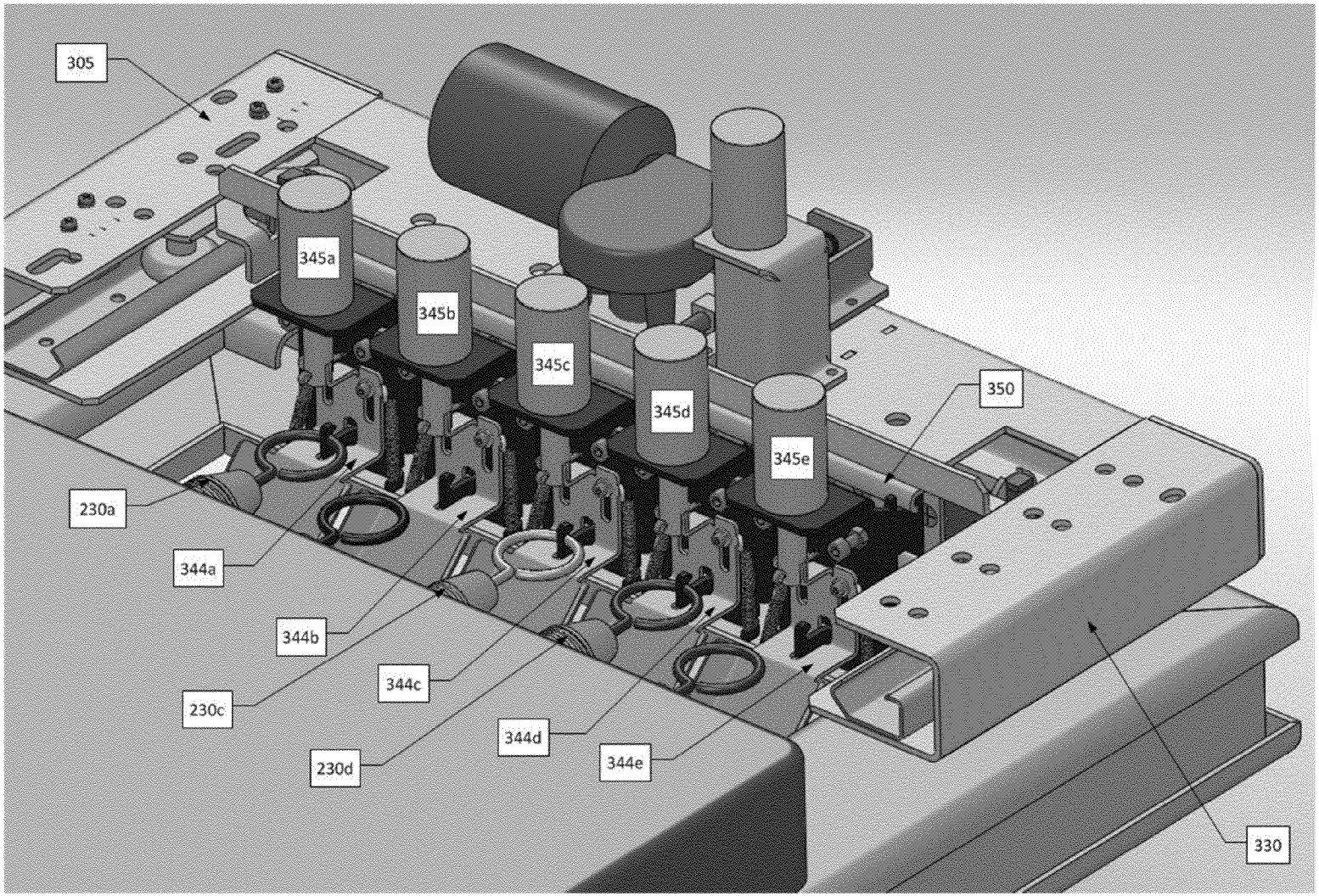

FIG. 6 and FIG. 9 illustrate the initial positioning of a spring end 232 relative to the ramp 347 on the guide plate 344. As shown more particularly in FIG. 6, the spring 230 and spring end 232 are generally aligned with and lie on the same plane as the catch 343. In order to attach the spring end 232 to the catch 343, the ramp 347 is elevated by the actuator 345 and is advanced (by movement of the holder 350) toward the spring 230 to urge the spring end 232 to ride up the ramp 347 (FIG. 10) and come to rest on the opening 346 and over the catch 343. Thereafter, the actuator 345 is de-energized, which causes the guide plate 344 to fall and the spring end 232 to loop over and get caught on the catch 343, as shown in the embodiment of FIG. 11, which illustrates spring ends 232*a*, 232*c* and 232*d* captured on the catch 343 of connectors 340*a*, 340*c* and 340*d*. As illustrated in the embodiment of FIG. 11, once the desired number of springs 230 have been attached to their respective catches 343, the holder bar 350 draws all of the connectors 340 including connectors 340*b* and 340*e* away from the unattached spring ends 232*b* and 232*e* while maintaining guide plates 344*b* and 344*e* in the elevated position to maintain the spring ends 232*b* and 232*e* unattached, and then as shown in the embodiment of FIG. 12, the actuators 345*b* and 345*e* are de-energized to cause the remaining guide plates 344*b* and 344*e* to drop into a rest position, exposing their respective catches 343*b* and 343*e*.

The rearward movement of the holder bar 350 also places an initial tension on the attached springs 230*a*, 230*c* and 230*d* which serves to pre-tension the carriage 210 relative to the control system 300 and the chassis 330. Thereafter, the holder bar 350 can be moved in a controlled manner to variably adjust the tension on the springs 230 to achieve a desired overall tension on the carriage 210, which allows for a finer tension adjustment as compared with changing the attachment of the springs 230 with respect to the connectors 340. Thus, while a user can modify the tension by connecting or disconnecting one or more than one spring 230, the user can modify the tension even more by adjusting the distance of the holder bar 350 once connected to the springs 230.

Releasing the springs 230 from the connectors 340 is a matter of reversing the above operation, where the holder 350 advances the connectors 340 toward the springs 230 to release the tension between the springs and the connectors 340, following by the energizing of the actuators 345 to lift the guide plates 344 causing the spring rings 232 to detach from the catches 343 and ride upward on the guide plates 344, followed by the withdrawal of the holder 350 and connectors 340 away from the springs 230, which results in the spring rings 232 sliding down the ramps 347 and away from the control system. Engaging and releasing the connectors 340 with respect to the springs 230 is handled automatically with the use of the control system 300, as guided by the processor 305, in accordance with direction from a user or as scheduled by a user's exercise regimen. For example, if a user progresses through a series of exercises, each requiring a different tension, a user can program the control system 300 to automatically adjust the tension as the user progresses through each successive exercise, so that the user does not actually have to manually manipulate the springs 230 and disrupt the exercise routine. Furthermore, there is less of a chance of user error in selecting the appropriate tension as the decision and selection is performed and controlled automatically by the control system 300 and processor 305.

The decision to attach one or more springs 230 is controlled by the processor 305 and is driven by a user desiring a particular tension arrangement achieved by a certain combination of springs 230. Each spring 230 may have the same tension characteristics, where the attachment of each successive spring results in an equal and incremental addition of tension. Alternatively, each spring may have a different tension characteristic, where a desired tension may be achieved by attaching a particular combination of springs that is calculated and controlled by the processor 305. For example, if each of the springs 230 has a different identifiable tension characteristic, then the total tension can be adjusted by attaching different combinations of one or more springs 230, where there are thirty-two possible tension combinations with one to five springs, sixty-four possible tension combinations with one to six springs, and so on. A user may change the tension arrangement manually by inputting a particular tension value into one of the control panels 312 or 322, or a user may override the control system and physically change the spring arrangements by disconnecting the holder 350 from the gear array 364 (similar to how one would disconnect a power garage door from the track during a power outage).

As noted previously, direct access to the control system 300 by removal of the cover 310 and manual manipulation of the springs 230, etc., is not preferred, although it may be necessary during times of a power outage or in the event it is necessary to service the device or change the springs, etc. Since, in a preferred embodiment, the guide plates 344 are in the lowermost position (FIG. 8B) when the actuators 345 are not energized or powered, which exposes the catches 343 through the opening 346, the catches 343 can be accessed at all times. Thus, if the control system 300 (and the device as a whole) does not have power, a user can manually connect the appropriate combination of springs 230 to the catches 343 in order to create the desired tension value. Furthermore, the holder 350 may be disconnected from the motor 362 by removal of a locking device (not shown) and may be manually adjustable along the gear array 364 in order to vary the distance of the holder 350 relative to springs 230 in order to fine tune the tension arrangement.

Figure 13:
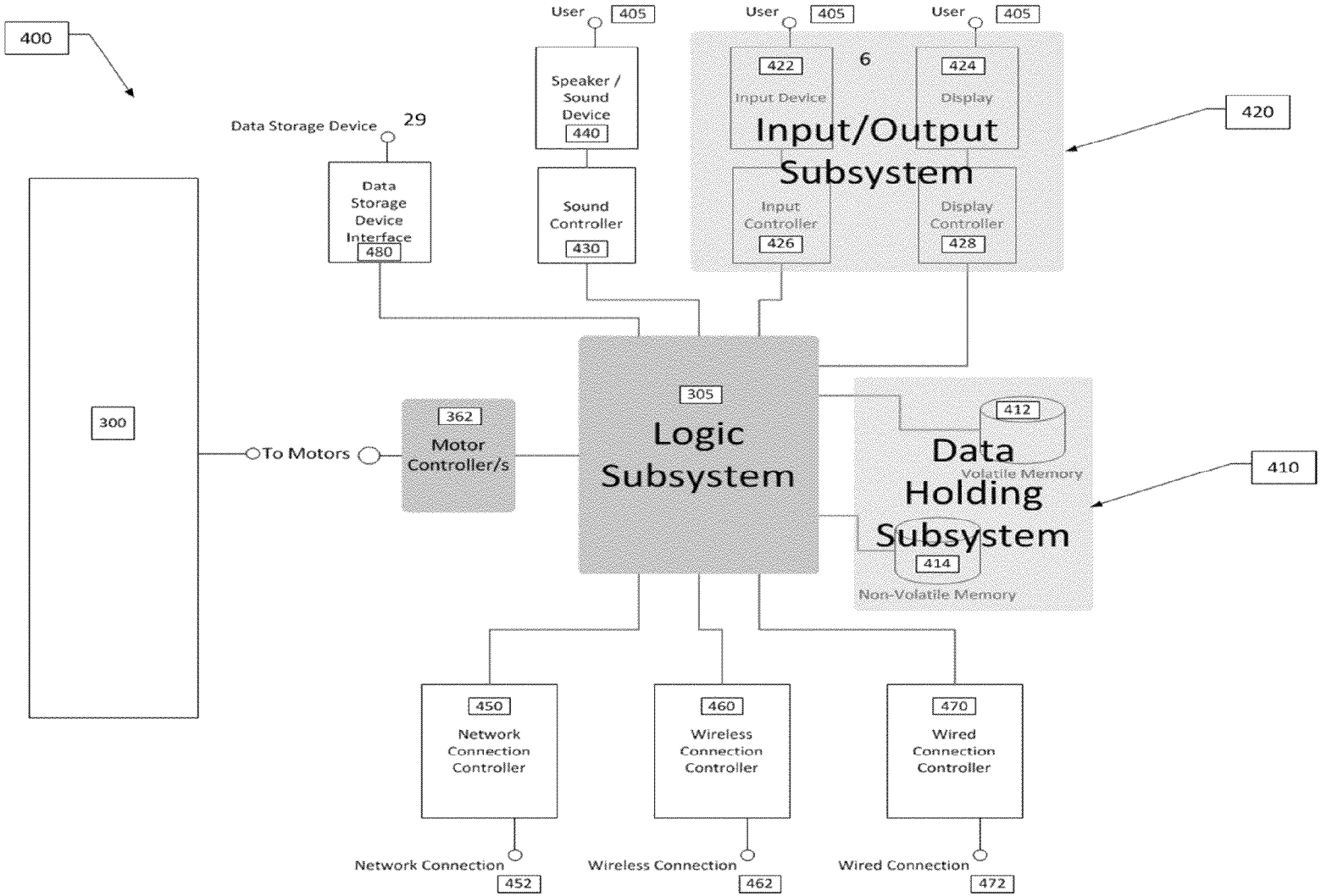
FIG. 13 illustrates one embodiment of a system diagram.

FIG. 13 illustrates one embodiment of a block diagram of the system 400 that illustrates the interface between the components of the control system 300, the processor 305, and additional peripheral components that are associated with the control system 300 and processor 305. Block 405 represents the movable components in the control system 300 including the motor 362 that is used to drive the gear array 364 and the holder 350, as well as the actuators 345 that drive the guide plates 344, as well as other movable components. The electromechanical moveable components are typically driven by separate controllers associated with each element that might take the form of a chip, microchip or the like, that electrically communicate commands between the processor 305 and the movable component(s) through the controllers.

The methods and processes described herein may be tied to a variety of different types of computing systems. Computing system may take a variety of different forms including, but not limited to, general purpose computers, specific purposes computers, specific purpose boards, gaming consoles, military systems and character acquisition systems offering green-screen or motion-capture functionality, among others. The processor 305, which functions as a logic subsystem within the computing and control system architecture, may be associated with a data-holding subsystem 410, an input/output (I/O) subsystem 420, and/or other devices not shown in FIG. 13. Some of the components shown in FIG. 13 may be peripheral components that are not integrated into the overall computing system associated with the control system 300 and processor 305 but that are separately attachable thereto.

The processor 305 may include one or more physical devices configured to execute one or more instructions. For example, the processor 305 may be configured to execute one or more instructions that are part of one or more programs, routines, objects, components, data structures, or other logical constructs. Such instructions may be implemented to perform a task, implement a data type, transform the state of one or more devices, or otherwise arrive at a desired result. Additionally or alternatively, the processor 305 may be associated with one or more hardware or firmware logic machines configured to execute hardware or firmware instructions, and may also optionally include individual components that are distributed throughout two or more devices, which may be remotely located in some embodiments.

Data-holding subsystem 410 may include one or more physical devices configured to hold data and/or instructions executable by the processor 305 to implement the herein described methods and processes. The state of data-holding subsystem 410 may be transformed (e.g., to hold different data). Data-holding subsystem 410 may further include removable media and/or built-in devices including optical memory devices, semiconductor memory devices (e.g. RAM, EEPROM, flash. etc.), and/or magnetic memory devices, among others, including volatile memory 412 and non-volatile memory 414. Data-holding subsystem 410 may also include devices with one or more of the following characteristics: volatile, nonvolatile, dynamic, static, read/write, read-only, random access, sequential access, location addressable, file addressable, and content addressable. In some embodiments, the processor 305 and the data-holding subsystem 410 may be integrated into one or more common devices, such as an application specific integrated circuit or a system on a chip. Other configurations are possible. FIG. 13 also shows an aspect of the data-holding subsystem 410 in the form of computer-readable removable media 416, which may be used to store and/or transfer data and/or instructions executable to implement the herein described methods and processes.

I/O subsystem 420 may be used to present a visual representation of data held by data-holding subsystem 410. As the herein described methods and processes change the data held by the data-holding subsystem 410, and thus transform the state of the data-holding subsystem 410, the state of I/O subsystem 420 may likewise be transformed to visually represent changes in the underlying data. The I/O subsystem 420 can include, but not be limited to, input and output devices 422, 424 such as a display or displays, a keyboard, touch screen, etc., that are driven by input and display controllers 426 and 428. For example, with reference to FIG. 3, an I/O subsystem 420 may be represented by control panels 312 and 322, including displays 314 and 322, keypad 316, speaker 328 and so on. The processor 305 can also be connected to a sound controller 430 and through it to speaker and/or microphone 440, which can be used for interfacing with users 405 by giving voice details about the system status, alarms, counting repetitions, etc. A microphone 440 can be used, for example, for giving the system voice commands or for recording notes and the like. The processor 305 can also be connected to a variety of controllers including a network connected controller 450 via a network connection 452, and/or a wireless controller 460 via a wireless connection 462, and/or a wired controller 470 via a wired connection 472, for connection to a variety of controllers and other devices and systems including computers, mobile devices, mobile phones, smart devices, and so on.

Figure 3:
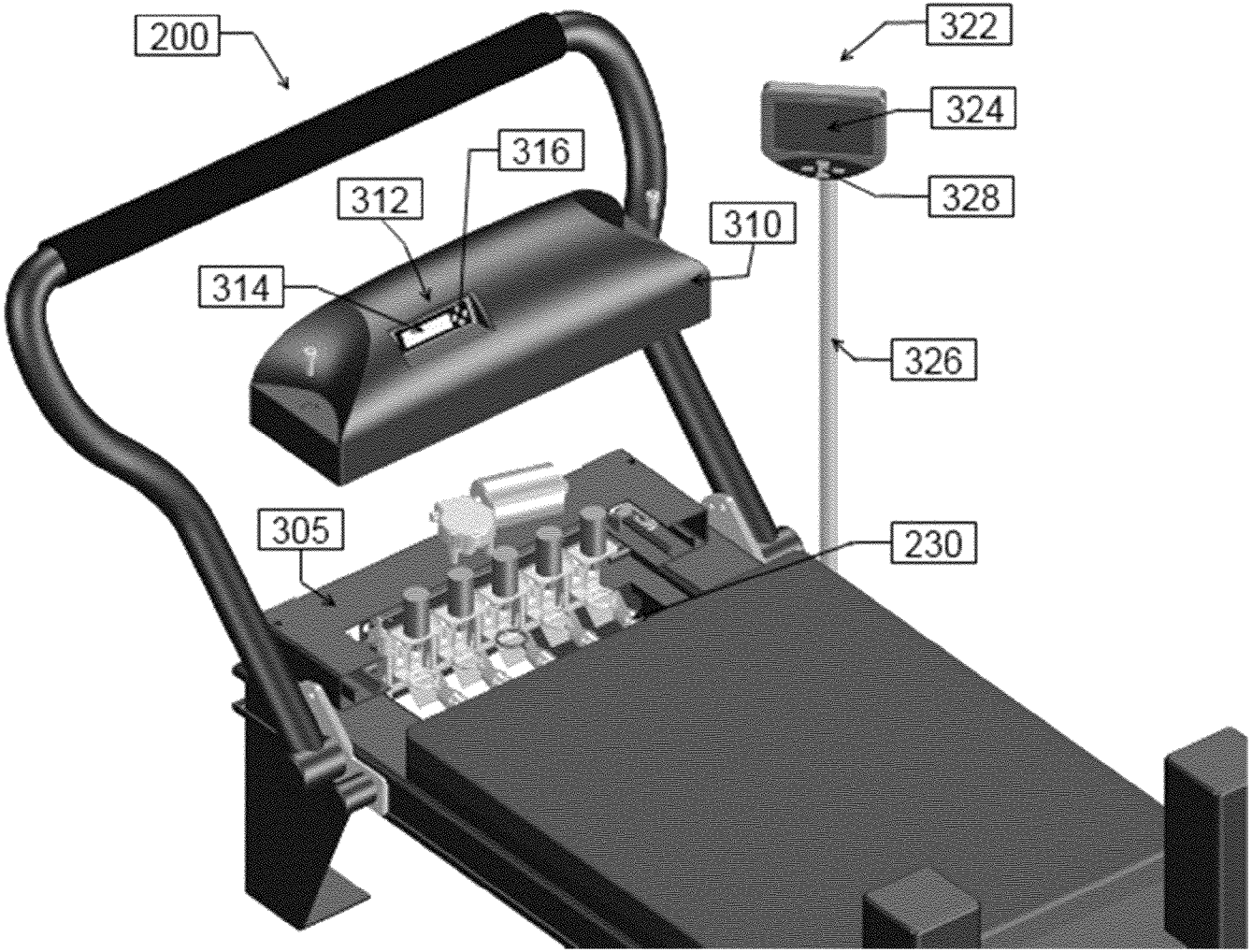
FIG. 3 illustrates one embodiment of a partially exploded frontal perspective view of an exercise device of the invention.

All of the components of the system 400 can be utilized for various applications such as, for example, identifying the user and setting the resistance according to the specific user, sharing information about exercise programs, setting the resistance based upon indications from other systems, etc. With reference to FIG. 3, a user can select an exercise regimen using the control panel 322, where one or a variety of exercise regimens is/are stored within the data holding system 480, or wherein an exercise regimen is available through a network connection 452 such as through a website provided by the manufacturer of the exercise device 200, or wherein the exercise regimen might be stored on a user's mobile device (not shown) that can communicate with the system 400 by via wireless connection 462 such as a Bluetooth connection.

A variety of feedback measurements can be achieved by associating various components with certain elements of the control system 300 and of the exercise device 200 in general. For example, a force measurement device (not shown) can be connected to one, some or all of the springs 230 to measure the amount of force a user is applying to the device 200 during use. A non-limiting example of a force measurement device can be a piezoelectric material with its one end connected to one, some or all of the springs 230 and the other end connected to a fixed part of the device such as the chassis 330 or the holder bar 350. As the spring(s) 230 expand and contract through the movement of the carriage 210, the piezoelectric material changes shape and orientation, causing it to change one or more of its electrical characteristics (like voltage or current level), which allows the force applied by a user to be measured. Another non limiting example can be connecting a different type of force measuring device instead of the piezoelectric material (for example a spring based force measuring device). Yet another implementation can be measuring the elongation of the springs 230 to determine the amount of force the springs apply on the user. This measured amount of force can be presented to the user through the control panels 312 and/or 322 and/or can be fed into the data holding system 410 through the processor 305 for storing in connection with a user's exercise regimen, and this information can also be further processed to present a variety of useful data to the user including number of carriage movements or repetitions, the accumulative strain on the user's muscles, calorie usage and more.

Other types of feedback can be delivered to a user based on various measurements taken from various sensors incorporated into the device 200. For example, a distance measurement device (not shown), which measures the distance traveled by the carriage 210, for example, can provide feedback to a user including the number of carriage movements and repetitions, the force exerted on the carriage, the length of a user's motion or the travel of the carriage, and so on. One example of such a device might be a wire or a cord (not shown) connected on one side to the carriage 210 next to a spring 230, with the other side supported on a reel (not shown) fixed to the chassis 330 about which the wire is wound. When the carriage 210 extends away from the control system 300, the reel releases the wire or cord and the amount of wire or cord released is measured to determine the outbound travel of the carriage. Inbound movement of the carriage is also tracked when the wire or cord retracts into the reel. This movement of the cord or wire and the distance traveled can be measured by electronically counting the reel's rotations. The rotations can be measured for example by using a rotary variable resistor, rotary encoder or other methods known to the skilled in the art. Other methods and apparatus are contemplated, and may include an ultrasonic distance measuring device connected for example to the chassis 330 measuring the distance to a reflective element on the carriage 210, or a light beam based measuring device connected similarly. Other methods are possible.

Figure 14:
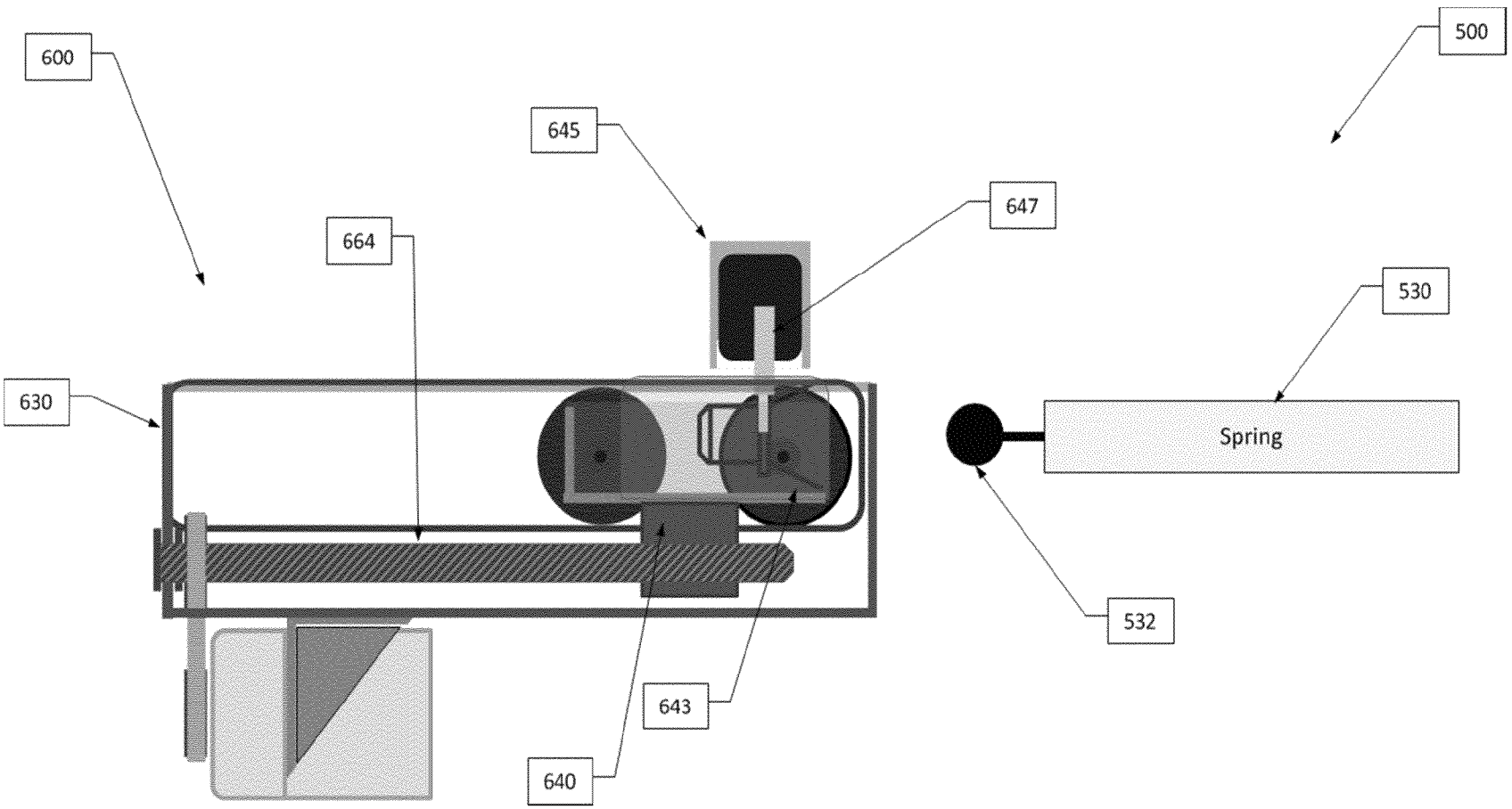
FIG. 14 illustrates one embodiment of a control system used with an exercise device of the invention.

FIG. 14 through FIG. 18B illustrate various non-limiting alternate embodiments of certain aspects of the present invention, and in particular those aspects relating to the connections between the tension elements (i.e. springs) and a fixed element that is anchored to the exercise device. In FIG. 14, there is provided an exercise device 500 having a control system 600 anchored to the device 500 by a chassis 630 that is adapted to receive a spring 530 with a spherical ball-shaped end 532 instead of a ring end as per the previously discussed embodiment. A connector 640, which is movable along a gear track 664 relative to the chassis 630 and to the springs 530, is provided with a cone 643 having an inward cylindrical geometry that is adapted to receive and seat the ball-shaped end 532 of the spring 530 and secure the end 532 within. An actuator 645 manipulates a guide plate 647 between an engagement and a disengagement position and functions in a manner similar to the guide plate 347 of the previously described embodiment.

Figure 15A:
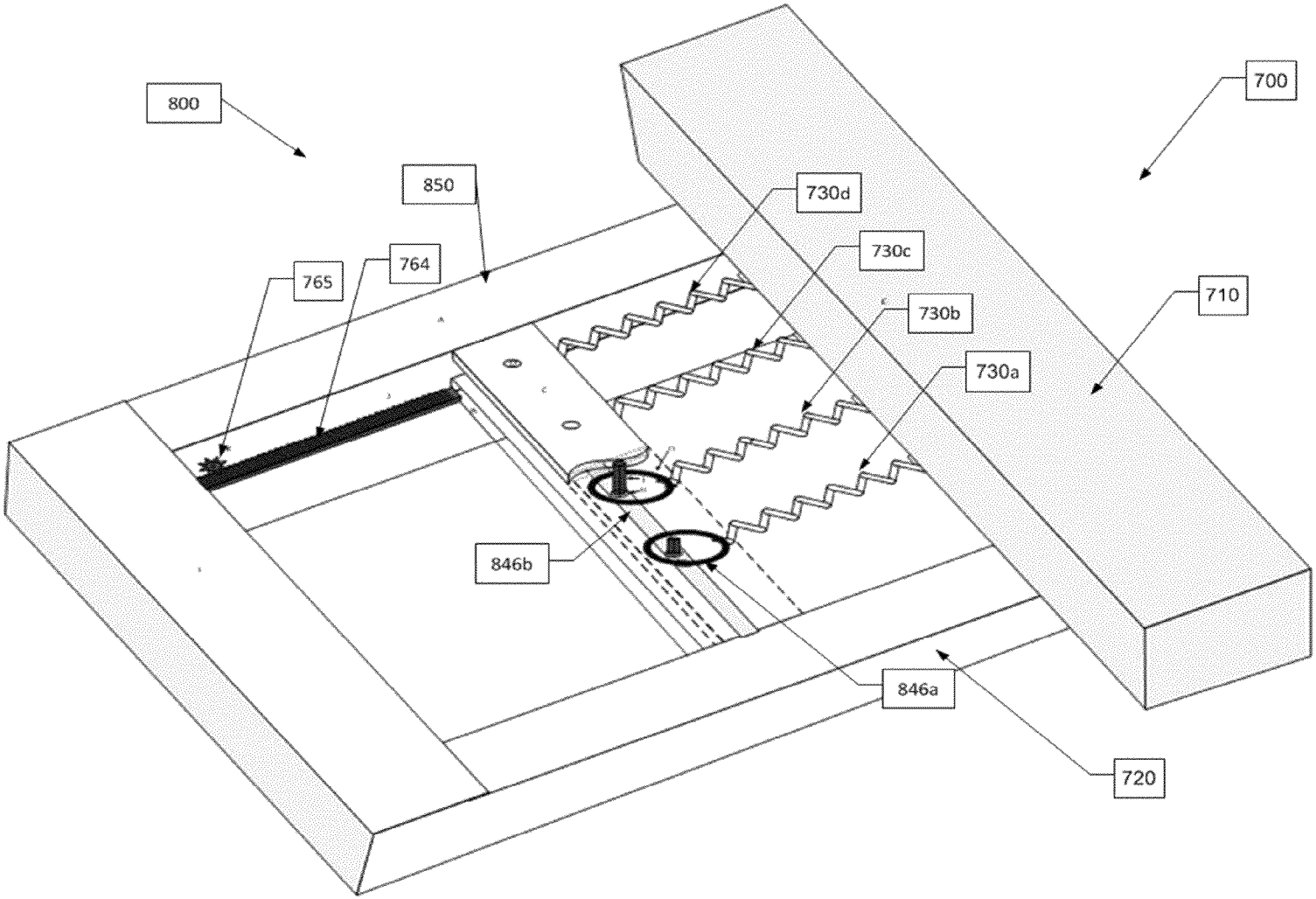
FIG. 15A and FIG. 15B illustrates an alternate embodiment of an exercise device of the invention.
Figure 15B:
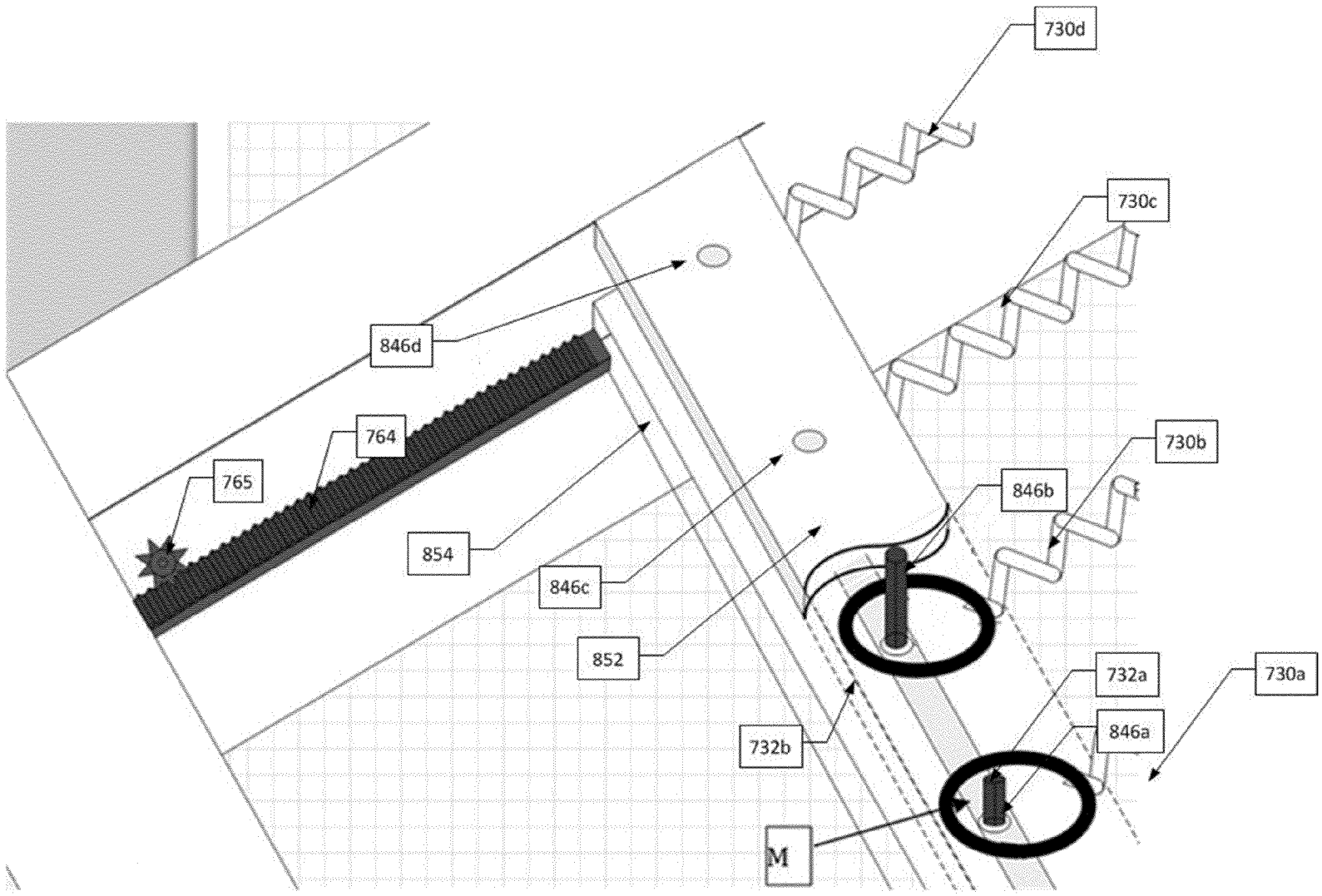

FIG. 15A and FIG. 15B illustrate an alternate embodiment of an exercise device 700 having an exercise carriage 710 that moves along rails 720 and is provided with a series of elastic elements or springs 730*a* through 730*d* having ring-shaped ends 732*a* through 732*d* (only 732*a* and 732*b* being shown), and a control system 800 formed from a tray 850 having a plurality of rods or posts 846*a* through 846*d* that are movable between a recessed position (see post 846*a*) and an extended position (see post 846*b*). The tray 850 is formed from an upper plate 852 and a lower plate 854 and is connected to the rails 720 of the device 700 by a gear track 764 and a gear 765 that causes the tray 850 to move relative to the rails 720 and relative to the carriage 710. While rings 732 are described, it will be appreciated that other types of connecting elements can be used such as ellipses, hooks, a general rectangular shape with a hole in it, or any other mechanical arrangement that is configured to grab the rods or posts 846 extending from the lower plate 854. A spring ring 732 is attached to the tray 850 by positioning a ring around a recessed post 864 that is recessed within the lower plate 854 and extending the post 846 through the ring 732 and into the upper plate 852 to connect the upper plate 852 and the lower plate 854 by the post 846 through the ring 732. This can occur manually or electronically if the control system 800 is so designed. After the required springs 730 are attached to the tray 850 in accordance with tension requirements established by the user, the tray 850 can be moved rearward away from the springs 730, through the engagement of the gear 765 with the gear track 764, in order to initially tension the springs 730 relative to the carriage 710.

Figure 16A:
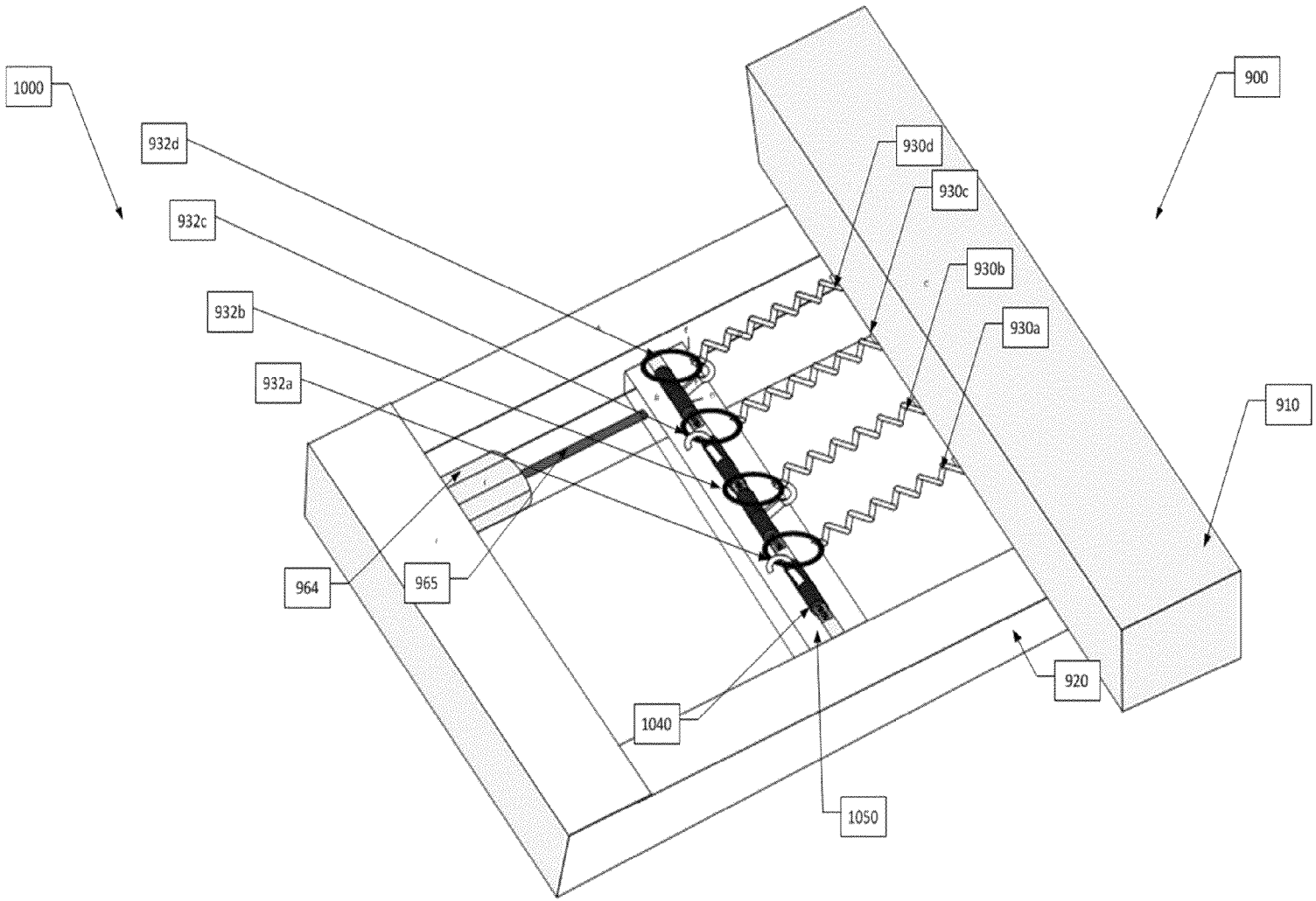
FIG. 16A and FIG. 16B illustrates an alternate embodiment of an exercise device of the invention.
Figure 16B:
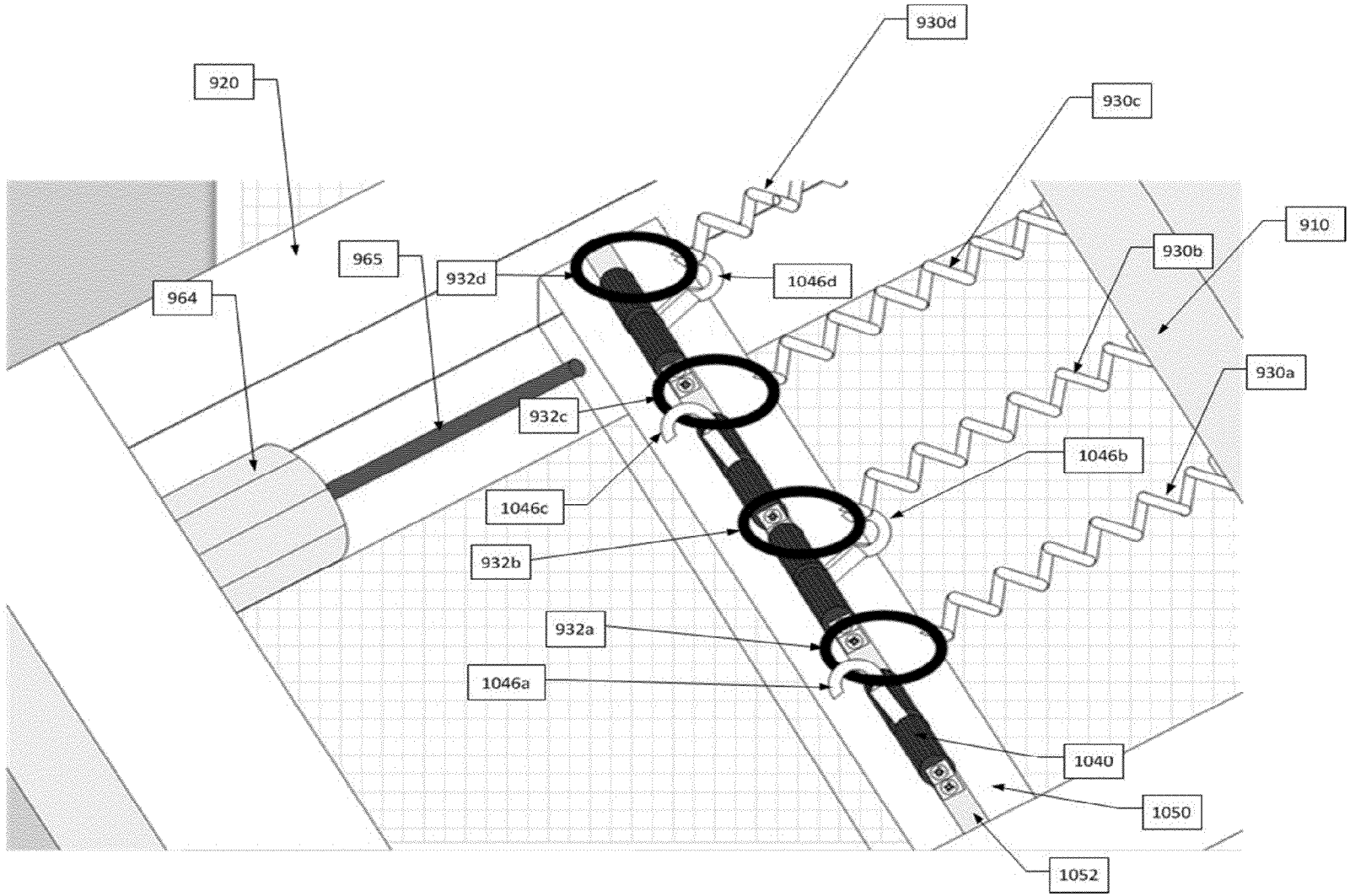

FIG. 16A and FIG. 16B illustrate an alternate embodiment of an exercise device 900 having an exercise carriage 910 that moves along rails 920 and is provided with a series of elastic elements or springs 930*a* through 930*d* having ring-shaped ends 932*a* through 932*d*, and a control system 1000 formed from a tray 1050 with a pivot rod 1040 having a plurality of hooks 1046*a* through 1046*d* that are independently rotatable relative to the tray 1050 along an axis 1052 of the pivot rod 1050 between a disengaged position (see hook 1046*b*) and an engaged position (see hook 1046*a*). The rotation of the hooks 1046 may occur manually or in a controlled fashion by way of, for example, a motor and control system (not shown) provided in the tray 1050. The tray 1050 is connected to the rails 920 or to the frame of the exercise device by a piston 964 fixed to the frame 920 and a rod or cylinder 965 attached to the tray 1050. The piston 964 can be activated by air pressure, magnetic power, hydraulic or any other means now known or hereinafter developed. After the required springs 930 are attached to the tray 1050 in accordance with tension requirements established by the user, the tray 1050 can be moved rearward away from the springs 930, through the engagement of the piston 964 and rod 965, in order to initially tension the springs 930 relative to the carriage 910.

Figure 17A:
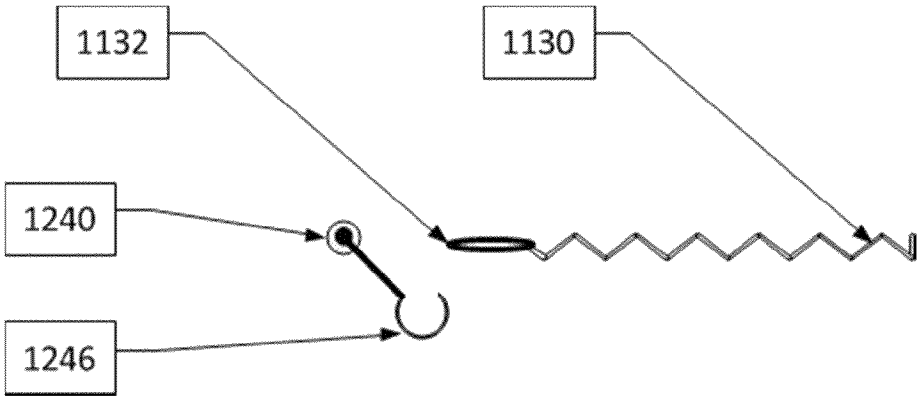
FIG. 17A and FIG. 17B illustrates a schematic view of an alternate embodiment of an exercise device of the invention.
Figure 17B:
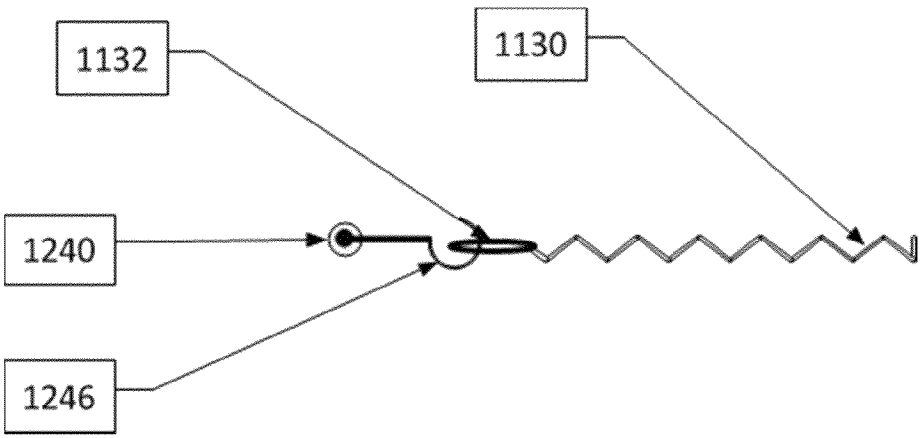

In the embodiment of FIG. 16A and FIG. 16B, as described in connection with earlier embodiments, the springs 930 can be replaced with other forms of elastic elements without departing from the scope of the present disclosure. Similarly the ring 932 and hook 1046 can each be replaced with another mechanical element that will create mechanical coupling similar to the one between the hook and ring. A non limiting example can be to replace the ring 932 with another hook. In certain embodiments, the movement of the hook 1046 may be different than that illustrated in FIG. 16A and FIG. 16B where, for example, the hook may move from a vertical or semi-vertical starting point, pointing for example downwards to a horizontal or semi-horizontal position, when the hook is engaged inside a ring, as shown in FIG. 17A and FIG. 17B, for example, where hook 1246 of pivot rod 1240 engages ring 1132 of spring 1130.

Figure 18A:
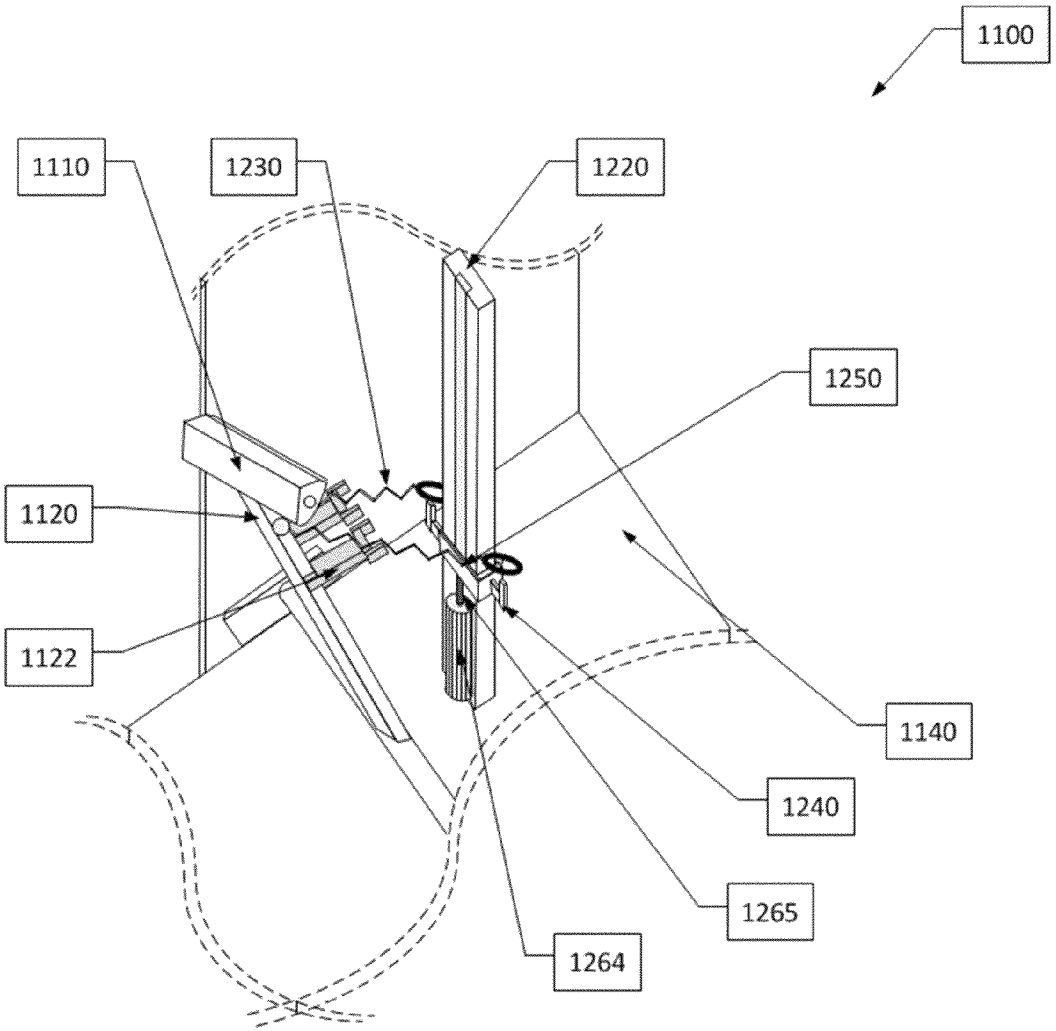
FIG. 18A and FIG. 18B illustrates an alternate embodiment of an exercise device of the invention.
Figure 18B:
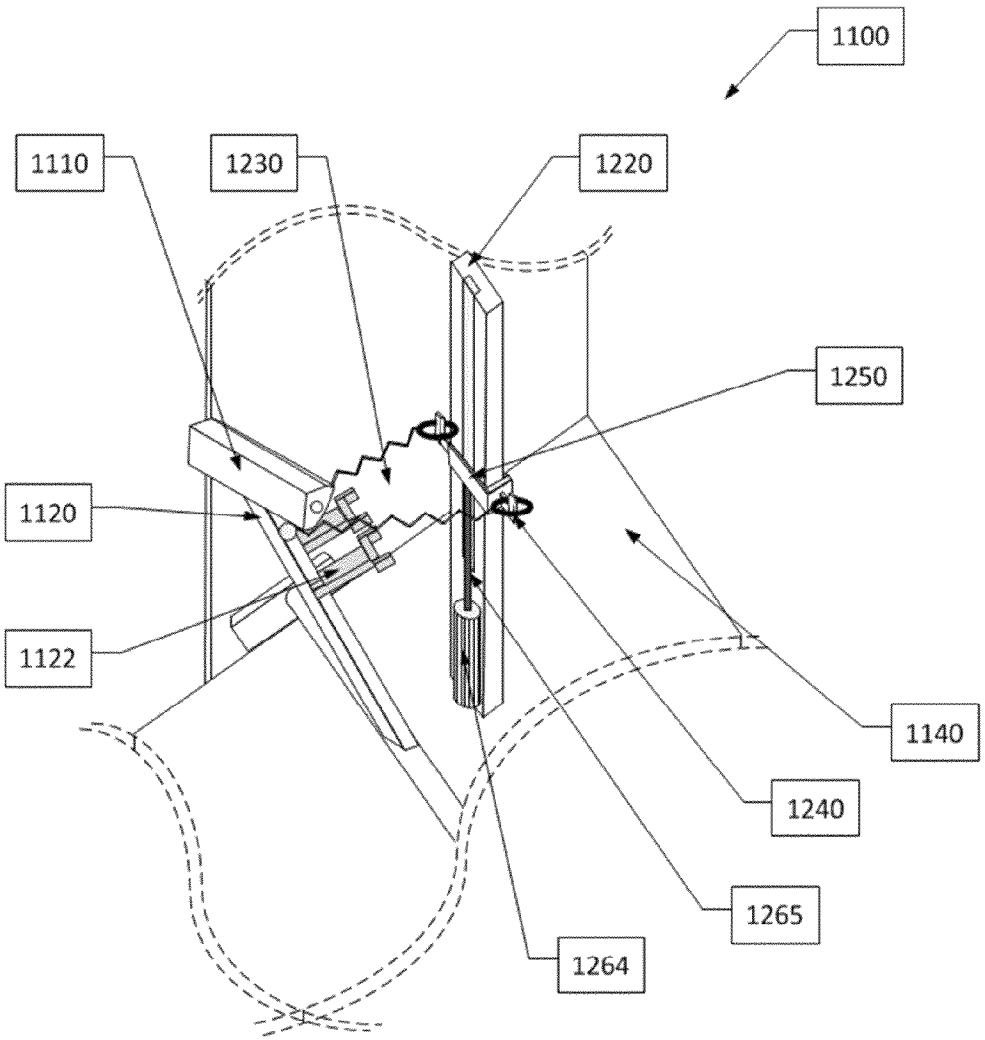

FIG. 18A and FIG. 18B illustrate an alternate embodiment of an exercise device 1100 in the nature of a Pilates chair of the type illustrated in U.S. Pat. No. 6,916,279, the contents of which are incorporated herein by reference, wherein it is desirable and preferable to bias the elastic elements not in a way which is parallel to their linear direction of contraction and expansion as described with certain previous embodiments herein. Instead, the elastic elements are initially biased and biased in a perpendicular or substantially perpendicular direction to their linear direction of contraction and expansion. The exercise device 1100 further comprises a movable support 1110 attached to a pivot arm 1120 that is movable relative to a base 1140 of the device 1100. A tray 1250 having a plurality of extensions 1240 is movably attached to an upright holder 1220 and is driven by a piston 1264 attached to the base 1140 and a cylinder or rod 1265 connected between the piston 1264 and the tray 1250. A plurality of tension elements 1230 are attached between the tray extensions 1240 and cradles 1122 on the pivot arm 1120, which cradles can function to both hold and store the tension elements 1230 out of the way during times of nonuse, and retain the tension elements 1230 connected to the tray 1250 during use of the device 1100. Attachment of tension elements 1230 to the cradles 1122 may require an initial movement of the cradles 1122 toward the tray 1250, or an elevation of the tray 1250 relative to the base 1140. In addition, while a pair of tray extensions 1240 are illustrated as hooks, it will be appreciated that there can be only one extension or more than two extensions, or that the extensions 1240 can assume other structural configurations without departing from the function of supporting the tension elements 1230 relative to the tray 1250.

The amount of tension placed on the movable support 1110, and therefore the amount of effort involved in pivoting the movable support 1110 about the pivot arm 1120, is a function of the amount of tension generated by the tension elements 1230 between the tray extensions 1240 and the cradles 1122. A greater amount of tension is contributed by the tension elements connected between the tray extensions 1240 and the cradles 1122 when the tray 1250 is positioned closer to the base 1140 as shown in FIG. 18A, while the tension can be reduced by extending the tray 1250 away from the piston 1264 to shorten the distance between the tray extensions 1240 and the cradles 1122 as shown in FIG. 18B. The piston 1264 can be activated by air pressure, magnetic power, hydraulic power or any other means now known or hereinafter developed that can be implemented by one skilled in the art. Other devices for achieving the up and down movement of the tray 1250 are also possible and can replace the piston 1264 and push/pull rod 1265. Non-limiting examples of such devices can include a solenoid, an electric motor controlling a cog wheel which runs on a track or any other device that can be implemented by those skilled in the art. Thus, the initial tension experienced by the movable support 1110 is a function of the height of the tray 1250 relative to the base 1140, which is substantially perpendicular to the linear extension of the tension element 1230 relative to the movable support 1110. The amount of tension can then be modified by varying the position of the tray 1250, which can be manually controlled by a switch (not shown), or which can be manually controlled through manual manipulation of the tray 1250 relative to the holder 1220, or automatically controlled by a control system (not shown) depending on the amount of desired tension for a particular exercise. Similar to previously disclosed embodiments, a control system can be associated with an input/output subsystem and/or a data holding subsystem and/or various controller and interface solutions for optimal communications with a user of the device.

Also, it is to be understood that the number of elastic elements or springs appearing in any of the embodiments described herein is meant to only be illustrative and is not meant to be limiting in configuration, arrangement or number of elements.

The block diagram of FIG. 13 illustrates the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions described herein. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

Aspects of the invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Aspects of the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain or store the program for use by or in connection with the instruction execution system, apparatus, or device.

The medium is tangible, and it can be an electronic, magnetic, optical, electromagnetic, infrared, or semiconductor system (or apparatus or device). Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A system for controlling a tension in an exercise apparatus comprising:

a) a fixed support;

b) a plurality of connectors that are collectively attached to a holder, the holder being movable relative to the fixed support, each of the plurality of connectors further comprising a catch for attachment to a tension member of a plurality of tension members from an exercise apparatus;

c) a plurality of guides that are respectively associated with the plurality of connectors;

d) each of the plurality of guides being independently movable between a first position for positioning the tension member relative to the catch where the catch is inaccessible for attachment to the tension member, and a second position where the catch is exposed for attachment to the tension member, wherein each of the plurality of guides further comprises an opening for passage of the catch in the second position and a ramp for guiding the tension member into the first position away from the opening; and e) a control system for controlling the movement of the plurality guides for selective attachment of the tension members to the catches, and for controlling the movement of the holder for controlling the tension of the tension members attached to the catches.

2. The system of claim 1, wherein the control system is an electronic control system.

3. The system of claim 2, wherein the control system further comprises a display.

4. The system of claim 1, further comprising an actuator associated with each of the plurality of connectors for moving the guide between the first and second positions.

5. The system of claim 4, further comprising another actuator associated with the holder for moving the holder relative to the fixed support.

6. The system of claim 1, wherein the ramp further comprises angled side walls.

7. The system of claim 1, wherein the catch further comprises a hook.

8. An exercise device comprising:

a) a fixed support;

b) a plurality of tension members;

c) a plurality of connectors that are collectively attached to a holder, the holder being movable relative to the fixed support, each of the plurality of connectors further comprising a catch for attachment to a tension member of a plurality of tension members;

d) each of the plurality of connectors being independently movable relative to the respective tension member between a first position where the tension member is aligned with but not attached to the catch, and a second position where the tension member is aligned with and attachable to the catch;

e) a plurality of guides that are respectively associated with the plurality of connectors, each of the plurality of guides being independently movable between the first position for positioning the tension member relative to the catch where the catch is inaccessible for attachment to the tension member, and the second position where the tension member is attachable to the catch, wherein each of the plurality of guides further comprises an opening for passage of the catch in the second position and a ramp with angled side walls for guiding the tension member into the first position away from the opening; and f) a control system for controlling the movement of the holder for controlling the tension of the tension members attached to the catches.

9. The exercise device of claim 8, further comprising an actuator associated with each of the plurality of connectors for moving the connectors between the first and second positions.

10. The exercise device of claim 9, further comprising another actuator associated with the holder for moving the holder relative to the fixed support.

11. The exercise device of claim 10, further comprising an electronic input/output subsystem associated with the control system.

12. The exercise device of claim 11, further comprising an electronic data holding subsystem associated with the control system.

13. The exercise device of claim 8, wherein the catch further comprises a slidable rod.

14. The exercise device of claim 8, wherein the catch further comprises a hook rotatably attached to the holder.

15. The exercise device of claim, 8, wherein the tension members are movable in a first plane and the holder is movable in a second plane that is different from the first plane.

* * * * *